US009302834B2

(12) United States Patent
Campesino

(10) Patent No.: US 9,302,834 B2
(45) Date of Patent: Apr. 5, 2016

(54) DISPENSING SYSTEM

(71) Applicant: Justin Campesino, Loveland, CO (US)

(72) Inventor: Justin Campesino, Loveland, CO (US)

(73) Assignee: Justin Campesino, LLC., Fort Collins, CO (US)

( * ) Notice: Subject to any disclaimer, the term of this patent is extended or adjusted under 35 U.S.C. 154(b) by 94 days.

(21) Appl. No.: 14/159,882

(22) Filed: Jan. 21, 2014

(65) Prior Publication Data

US 2014/0235417 A1 Aug. 21, 2014

Related U.S. Application Data

(60) Provisional application No. 61/754,830, filed on Jan. 21, 2013.

(51) Int. Cl.

| | |
|---|---|
| ***B65D 65/00*** | (2006.01) |
| ***B65D 75/00*** | (2006.01) |
| ***B65D 71/36*** | (2006.01) |
| ***B65D 71/38*** | (2006.01) |
| ***B65D 1/02*** | (2006.01) |

(52) U.S. Cl.

CPC ..... *B65D 71/36* (2013.01); *B65D 1/0276* (2013.01); *B65D 71/38* (2013.01); *B65D 2571/0029* (2013.01); *B65D 2571/0032* (2013.01); *B65D 2571/0045* (2013.01); *B65D 2571/0066* (2013.01); *B65D 2571/00141* (2013.01); *B65D 2571/00234* (2013.01); *B65D 2571/00401* (2013.01); *B65D 2571/00444* (2013.01); *B65D 2571/00666* (2013.01); *B65D 2571/00728* (2013.01); *B65D 2571/00746* (2013.01); *B65D 2571/00777* (2013.01); *B65D 2571/00783* (2013.01)

(58) Field of Classification Search

CPC ..... B65D 71/0037; B65D 71/004; B65D 2571/00283; B65D 2571/0029; B65D 71/0029; B65D 71/0048

USPC ..... 206/427–435, 139–203; 229/117.13

See application file for complete search history.

(56) References Cited

U.S. PATENT DOCUMENTS

| | | | | | |
|---|---|---|---|---|---|
| 827,124 | A | * | 7/1906 | Speer | 220/509 |
| 1,965,886 | A | * | 7/1934 | Everhart | 206/165 |
| 2,173,494 | A | * | 9/1939 | Arthur Rous | 206/168 |
| 2,225,822 | A | * | 12/1940 | Crook | 206/168 |
| 2,268,209 | A | * | 12/1941 | Ford et al. | 206/168 |
| 3,081,928 | A | * | 3/1963 | Chidsey, Jr. et al. | 206/149 |
| 3,096,906 | A | | 7/1963 | Chidsey, Jr. et al. | |

(Continued)

*Primary Examiner* — Chun Cheung

(74) *Attorney, Agent, or Firm* — Sheridan Ross P.C.

(57) ABSTRACT

A dispensing system based on secondary packaging having side panels forming a tubualar form, top and bottom panels held substantially perpendicular to the side panels of the secondary package, and optionally including a stabilizing insert. Apertures in the top panel and posts in the bottom panel are provided to stabilize and support primary packages in the secondary package. The apertures in the top panel are sized to allow a primary package to be removed individually by passing through such aperture. Primary packages within the secondary package are biaxially supported between apertures in the top panel surrounding an elongated neck on the primary package and posts in the bottom panel that interlock with a depression in the bottom of the primary package. Such dispensing system can be opened and individual primary packages removed without exposing any other primary containers held within the dispensing system, while maintaining stable storage and transportation utility in the system.

9 Claims, 19 Drawing Sheets

(56) References Cited

U.S. PATENT DOCUMENTS

| | | | | | |
|---|---|---|---|---|---|
| 3,333,729 | A | * | 8/1967 | Rabb | 206/196 |
| D209,240 | S | | 11/1967 | Plogsted | |
| 3,895,713 | A | * | 7/1975 | Bunnell | 206/427 |
| 4,040,517 | A | * | 8/1977 | Torokvei | 206/144 |
| 4,040,550 | A | | 8/1977 | Kleinert | |
| 4,478,334 | A | * | 10/1984 | Graser | 206/427 |
| D289,011 | S | | 3/1987 | Rusnock et al. | |
| 5,558,224 | A | * | 9/1996 | Fogle | 206/427 |
| 5,590,776 | A | | 1/1997 | Galbierz et al. | |
| 5,816,391 | A | | 10/1998 | Harris | |
| 5,975,300 | A | * | 11/1999 | Gale | 206/433 |
| 6,168,012 | B1 | | 1/2001 | Galbierz | |
| 6,527,116 | B1 | * | 3/2003 | Gale | 206/427 |
| 6,758,337 | B2 | | 7/2004 | Chargueraud et al. | |
| D506,670 | S | | 6/2005 | Borkoski | |
| 7,870,957 | B2 | | 1/2011 | Holley, Jr. et al. | |

* cited by examiner

DISPENSING SYSTEM

CROSS REFERENCE TO RELATED APPLICATION

This application claims the benefit of priority under 35 U.S.C. §119(e) to U.S. Provisional Patent Application Ser. No. 61/754,830 filed Jan. 21, 2013, which is incorporated herein by reference.

TECHNICAL FIELD

The invention relates to a system of dispensing primary packages that provides improvements to the configuration and construction of secondary packaging over known secondary packaging or dispensing systems, to provide secondary packaging that remains stable and functional after opening and removal of one or more primary packages.

BACKGROUND OF INVENTION

Primary packaging refers to the material that first envelops and holds a product. This usually is the smallest unit of distribution or use and is the package in direct contact with the contents. Secondary packaging refers to packaging outside the primary packaging—perhaps used to group primary packages together. Tertiary packaging is used for bulk handling, warehouse storage and transport shipping of the secondary packaging containing the primary packaging. The most common form is a palletized unit load that packs tightly into shipping primary packages.

Secondary packaging specific for bottles and cans is well known, and many improvements to such secondary packaging have been made over the years. Currently, there are essentially two varieties of secondary packaging for bottles and cans: the secondary package that receives the bottles and cans, described as a "basket container" in U.S. Pat. Nos. 6,571,941 and 7,913,837, and those described as "planar" or "box-top container" as described in U.S. Pat. Nos. 5,590,776 and 5,845,776. The "basket container" is in wide use, but suffers from structural weakness when individual primary packages are removed. Additionally, such packaging is typically unstable when stacked, which can result in significant breakage and loss of product from the primary packaging when the secondary packaging fails and/or falls. "Planar," or "box-top containers," on the other hand, have steadily been gaining acceptance in the beverage industry, but suffer from the same difficulties with respect to stacking, and additionally do not protect the primary packaging from damage due to insults received from sources external to the secondary packaging, such as tertiary packaging or other "box-top containers," or from primary packaging held within the same secondary package. Furthermore, both the "basket container" and the "box-top container" become increasingly unstable and susceptible to failure as primary packages, in the form of cans or bottles, are removed, until the secondary package tears or otherwise collapses releasing any remaining primary packages. Secondary can packages that have become popular in the past decade hold typically six or twelve cans horizontally in a linear carton stacked two- or three-deep. An end flap is torn open to access one or two cans from the end of the carton. As cans are removed from the open end of the carton, cans stacked within the secondary package force other cans forward, towards the open end, for access and/or removal from the carton. This carton thereby restrains the gravity fed primary containers, and allows for continued storage use once the carton has been opened. Such cartons are typically formed with a handle of sufficient strength that allows the package to be carried even after it has been opened. Unfortunately, after opening these cartons by removing an end flap, the primary packages within must be individually removed and moved, because the carton looses almost all stability and is no longer useful for transport of the primary packages without collapsing and/or releasing the individual primary packages remaining in the carton, regardless of the strength of the handle. Additionally, individual primary packages contained within the carton are exposed and are not protected or separated from one another and cannot be individually dispensed from the carton without further exposing all of the remaining primary packages contained within the carton. Thus, using this secondary can packaging, opening or dropping the secondary package or exposing it to extremes in temperature will distress or eliminate the stability of the condition of the secondary package as well as expose all of the primary package contents to damage.

Each of the foregoing disadvantages are overcome by the dispensing system of this invention. Additionally, the secondary packaging apparatus and dispensing methods of this invention achieve other advantages discussed more fully below.

SUMMARY OF INVENTION

This disclosure describes dispensing systems configured as secondary packaging that holds and protects primary packaging in a stable and protected manner such that individual primary packages can be removed without exposing the remaining primary packages and without weakening or destabilizing the secondary packaging.

One object of the present invention is to provide a dispensing system formed as a secondary package for securely carrying a plurality of primary packages.

Another object is to provide such dispensing system that maintains the strength and stability of the original secondary package, after the secondary package has been opened to remove one or more primary packages.

Another object is to provide the dispensing system with a release so that primary packages held within the secondary package can be easily removed from the secondary package without disturbing or releasing other primary packages held within the secondary package.

Another object is to provide such dispensing system with a primary package release mechanism and design that will not weaken the secondary package or allow remaining primary packages to become loose in the secondary package or fall out of the secondary package.

Another object is to provide such dispensing system with sufficient design strength and integrity to protect primary packages stored within the secondary packaging as well as continued storage capabilities after the secondary package has been opened.

Another object is to provide such a dispensing system that will minimize or prevent primary packages within the secondary package from impacting each other when they are carried or stored in the secondary package.

Another object is to provide such dispensing system that maximizes the planar strength of the secondary package, in part by using an internal stabilizing means, which may also act to minimize primary package impacts within the secondary package.

Another object is to provide message space on the dispensing system for display of advertisement, UPC codes, etc. without interfering with the release of primary package(s) from the secondary package.

Another object is to provide a dispensing system that may be produced at high speed as a flat blank, and shipped in bulk in the flat state, to be efficiently assembled after shipping, into a secondary packaging dispensing system with some or all of the advantages stated herein.

Another object is to provide such dispensing system which is recyclable and/or made from recycled materials.

These and other objects will become apparent to those skilled in the art in light of the following disclosure and accompanying drawings.

The invention provides secondary packages for primary packages having consumer friendly carrying and dispensing features that also maintain their strength and stability in holding primary packages during transport or storage, even after the secondary package has been opened to remove one or more of the primary packages held within.

The secondary package of the invention generally includes top-, side-, and bottom-panel(s) to form a secure and stable secondary package.

In one embodiment, the secondary package of the invention includes a top panel, side panels, and a bottom panel extending between the side panels to form a generally hexagonal sleeve. The top and bottom panels close the ends of the hexagonal secondary package. The end panels may extend the height and width of the secondary package ends. Alternatively, the top and/or bottom panel may independently be configured to engage an end of the hexagonal sleeve at a recessed position below the top or bottom edge of the hexagonal sleeve, thereby providing additional stability to the hexagonal sleeve while further securing primary packages within the secondary package. Locking panel(s) may be used to provide for each end panel to hold the end panel substantially perpendicular to the side panels, the top panel, and the bottom panel.

In one embodiment, the secondary package of the invention includes a top panel, side panels, and a bottom panel extending between the side panels to form a generally rectantular container. The top and bottom panels close the rectangular secondary package. The top and bottom panels may extend the height and width of the rectangular secondary package. Alternatively, the top and/or bottom panel may independently be configured to engage an end of the rectangular container at a recessed position below the top or bottom edge of the rectangular container, thereby providing additional stability to the rectangular container while further securing primary packages within the secondary package. Tabs may be provided to hold the to and/or bottom panels substantially perpendicular to the side panels.

The top panels in each of these embodiments may include a plurality of apertures. The top panel apertures include a plurality of slits radiating from each aperture edge to define a plurality of tabs. Each tab has a base, and the bases of the tabs, in turn, define a circle concentric about the top panel aperture.

The bottom panels in these embodiments include a plurality of posts. The apertures of the top panel and the posts of the bottom panel are generally aligned, so that a primary package that is passed through the top panel aperture will align with and engage at least one post on the bottom panel, thereby stabilizing the primary package between an aperture in the top panel and at least one post on the bottom panel, such that the primary package is biaxially supported. With the primary packages secured in this way within the secondary packaging, the invention provides a biaxially supported dispensing system for the primary packages.

The secondary packages of the invention may also include an internal stabilizing member. In one embodiment, the internal stabilizing member includes a center hub and between 1 and 12 arms radiating from the central hub. When present, the internal stabilizer may be positioned in, for example, the hexagonal sleeve that forms a secondary package embodiment of the present invention, such that the central hub is positioned substantially in the center of the hexagonal sleeve, with each arm radiating from the central hub to the internal surface of the hexagonal sleeve. In a preferred embodiment, the central hub and each of the arms radiating therefrom, extend within the hexagonal sleeve from the bottom panel to the top panel, to help strengthen and stabilize the sleeve, while preventing any primary packages present in the sleeve from directly touching one another. The central hub and each of the arms radiating therefrom have a maximum length equal to the length of the hexagonal sleeve from the interior of the bottom panel to the interior of the top panel.

The secondary package may be composed of cardboard/paperboard or plastic or polymeric materials that may be arranged in each of the side panels, top panel(s), and/or bottom panel(s) to form a single or two-ply side walls. To produce a secondary package with two-ply side walls, a blank is provided with two extra sections which form the extra plies of the sleeve, top panel, and/or bottom panel. Preferably, the extra panel sections are formed on either side of the top panel or bottom panel.

The secondary package is preferably provided with a plurality of openings that allow the the secondary package of the invention to be easily carried by the user in a substantially horizontal or vertical orientation when empty, partially full, or entirely full of primary packages. In one embodiment, three finger holes are located adjacent one another along one side of the secondary package, and a fourth elongated finger hole is located along another side of the secondary package substantially parallel to the three adjacent finger holes, such that a user's thumb can easily engage the fourth elongated finger hole while three of the user's fingers are engaged within the three adjacent finger holes, thereby allowing comfortable and convenient carrying of the secondary package in a substantially horizontal orientation. In some embodiments, the finger holes are closed by flaps. In some embodiments, the outer finger holes are each closed by two flaps which are separated by a line of weakness extending generally perpendicularly to the side edges of the secondary package. In these embodiments, any or all of the finger holes may be closed by flaps formed by cuts or perforations in the material of the secondary package.

Alternatively, or in addition to finger holes present in the secondary package, handles and/or straps may be provided along the sides of the secondary packaging or on either of the top or bottom panels to allow for additional ways to carry or open the secondary package, while empty, partially full, or full of primary packages.

This Summary of the Invention is neither intended nor should it be construed as being representative of the full extent and scope of the present invention. Moreover, references made herein to "the present invention" or aspects thereof, should be understood to mean certain embodiments of the present invention and should not necessarily be construed as limiting all embodiments to a particular description. The present invention is set forth in various levels of detail in the Summary of the Invention as well as in the attached drawings and the Description of Embodiments and no limitation as to the scope of the present invention is intended by either the inclusion or non-inclusion of elements, components, etc. in this Summary of the Invention. Additional aspects of the present invention will become more readily apparent from the Description of Embodiments, particularly when taken together with the drawings.

BRIEF DESCRIPTION OF DRAWINGS

FIG. 14B shows a side view of primary packages biaxially-supported within a rectangular secondary package of the present invention. FIG. 14C depicts a plan view of a rectangular secondary package of the present invention formed from the blank depicted in FIG. 14A

DESCRIPTION OF EMBODIMENTS

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

Figure 1:
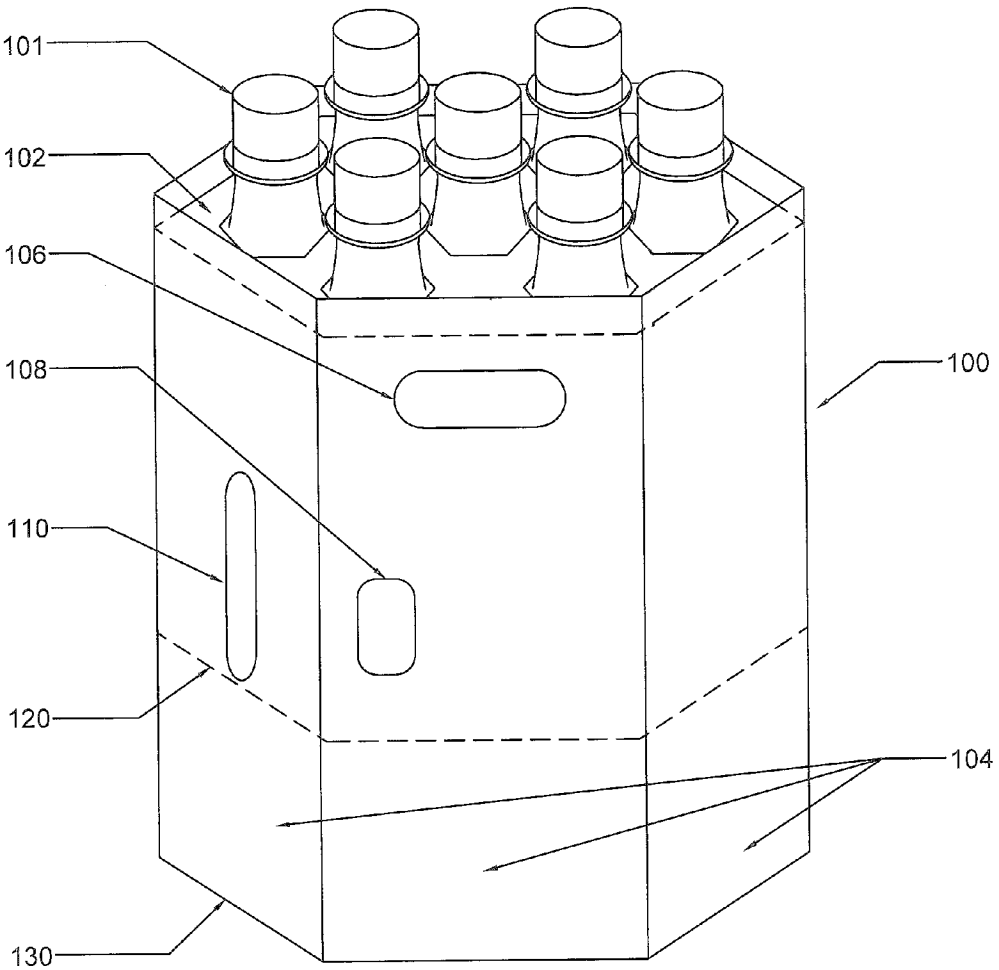
FIG. 1 is a side elevational view of a first embodiment of a secondary package of the present invention, having a hexagonal shape and having bottles disposed therein.

FIG. 1 depicts a multi-compartmented hexagonal secondary package comprising seven interior compartments configured to hold primary packages of materials, particularly liquids. The secondary package (100) is formed in a hexagonal shape composed of six side panels (104), closed at one end with a base (130) and shown loaded with seven primary packages (101) projecting through a recessed lid (102), which closes the opposing end of the hexagonal secondary package. As shown, the primary packages (101) within the secondary package are shown arranged in a hexagonal pattern with one primary package located at a central compartment.

The embodiment of the secondary package (100) depicted in FIG. 1 is formed with several openings that may be used to hold and carry the secondary package and its contents. One of the openings (106) is located below the recessed lid (102) proximate the top of the side panel (104). Such opening (110) is preferably of sufficient size to accommodate at least three fingers of a person carrying the secondary package (100).

Another opening (110) is located at a mid-point on a side panel (104) and is similar in size to opening (106), although oriented perpendicular to the recessed lid (102). Such opening (110) is preferably located proximate another opening (108) on an adjacent side panel (104). Such opening (108) is preferably of sufficient size to accommodate at least one finger of a person carrying the secondary package (100). In this orientation, a user may conveniently use the openings (110) and (108) to hold and transport the secondary package (100) by inserting several fingers in opening (110) and a thumb of the same hand into opening (108). FIG. 1 depicts one embodiment of the secondary package of the present invention comprising both openings (106) and (110/108), however, is to be understood that one, or both, or neither of these openings may be present in the secondary package of the present invention.

As described in greater detail below, a secondary package of the invention may contain an internal stabilizing member. FIG. 1 shows a height line (120) of an internal stabilizing member that may be used in one embodiment of the hexagonal configuration of the secondary packaging of the present invention.

Figure 2:
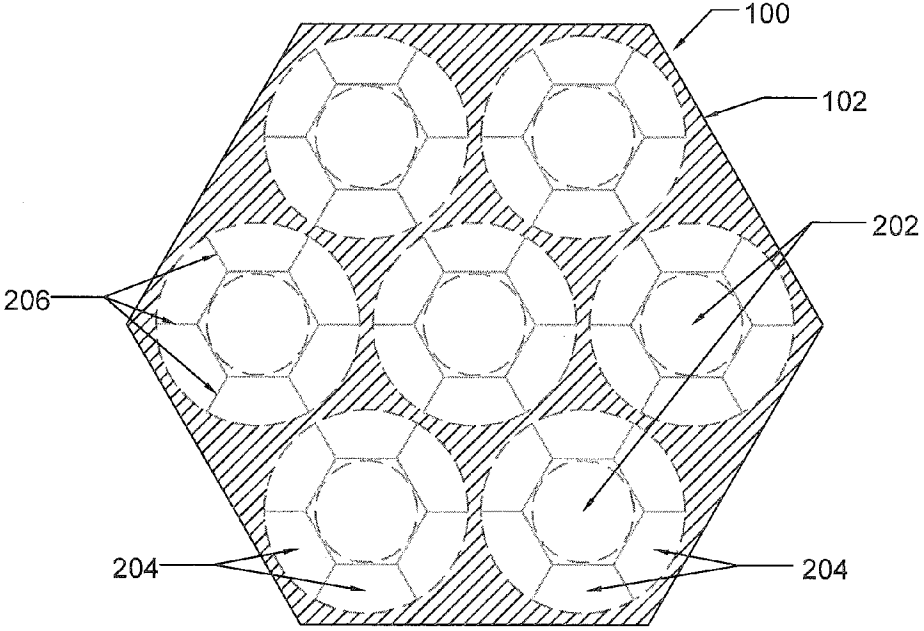
FIG. 2 is a view of the top of the secondary package of FIG. 1 with the top panel in place and without primary packages disposed therein.

FIG. 2B is a top view of the secondary package (100) of FIG. 1, showing the recessed lid (102) defining a plurality of openings (202). Each opening (202) is surrounded by apertures (204) which are evenly spaced around the openings (202). As shown in FIG. 2, seven openings (202) are located in the lid (102). In a preferred embodiment depicted in FIG. 2, seven openings (202) are arranged in a hexagonal pattern with one opening in the center of the hexagon. Other opening configurations with any desired number of openings could, of course, be used, as described below with respect to other configurations of the secondary packaging of the present invention. As depicted in FIG. 2, a plurality of slits (206) radiate outwardly from the center of the openings (202) to define the apertures (204) around the openings (202). The openings (202) preferably have a diameter sized to be substantially equal to the diameter of a circle defined by the top of the intended primary package to be held and transported within the secondary package (100). The apertures (204) define a folding point for the slits (206), which allows for expansion of the openings (202) to permit removal of a primary package from within the secondary package (100). Thus, openings (202) preferably define a diameter that is slightly smaller than the diameter of the primary package intended to be carried in the secondary package (100), such that the lid (102) holds the primary package securely within the secondary package (100) while in storage or transport.

Figure 3:
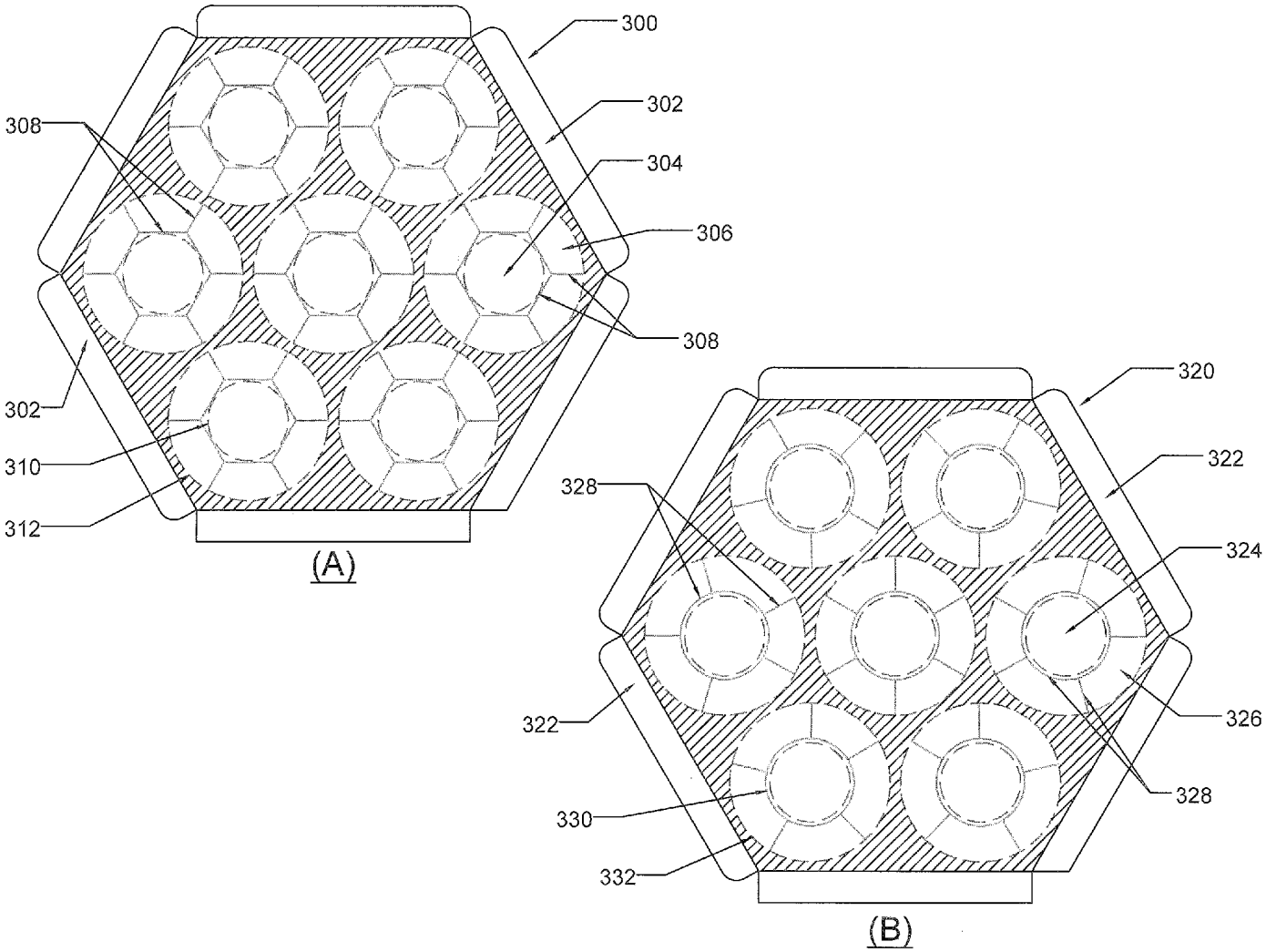
FIG. 3A shows one blank that may be used to form the top panel of the secondary package of FIG. 1.
FIG. 3B shows another blank that may be used to form the top panel of the secondary package of FIG. 1.
Figure 11:
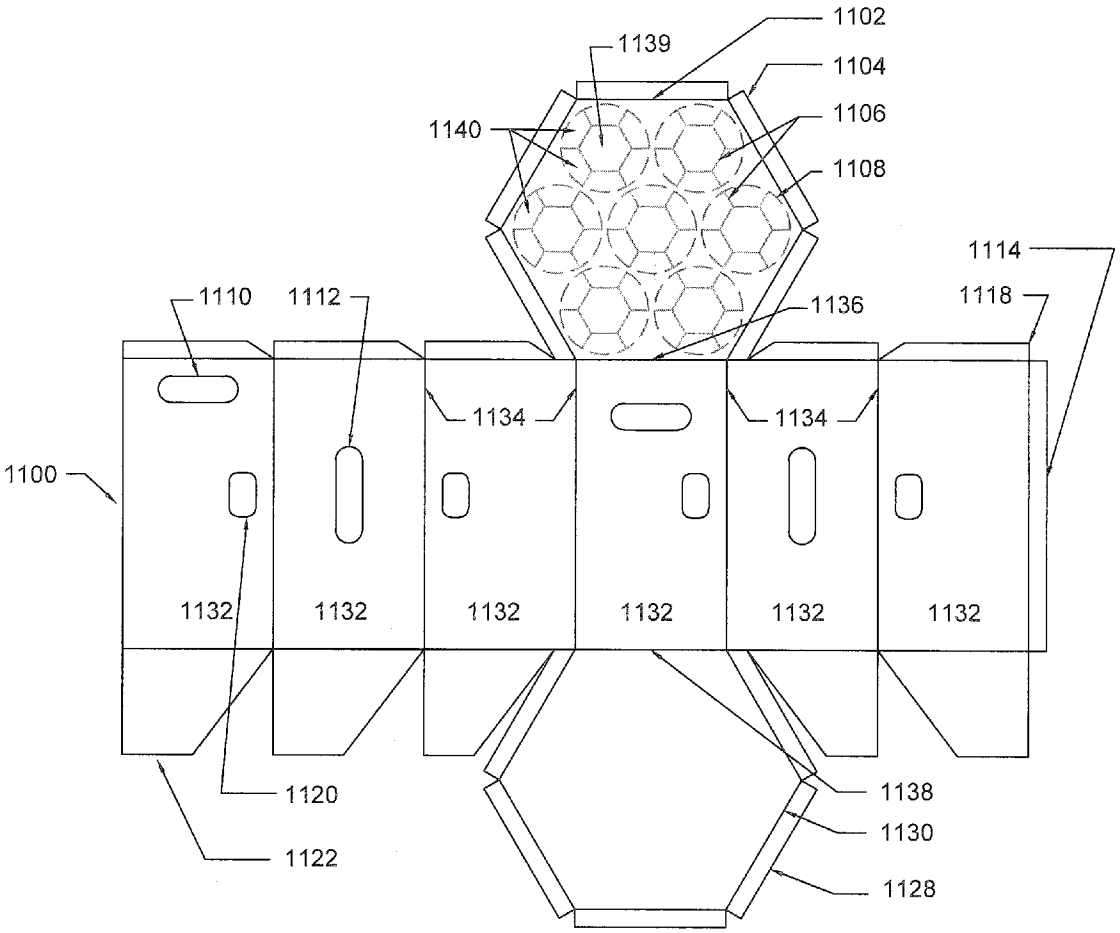
FIG. 11 shows a substantially flat blank that may be used to form a secondary package of the invention.
Figure 12:
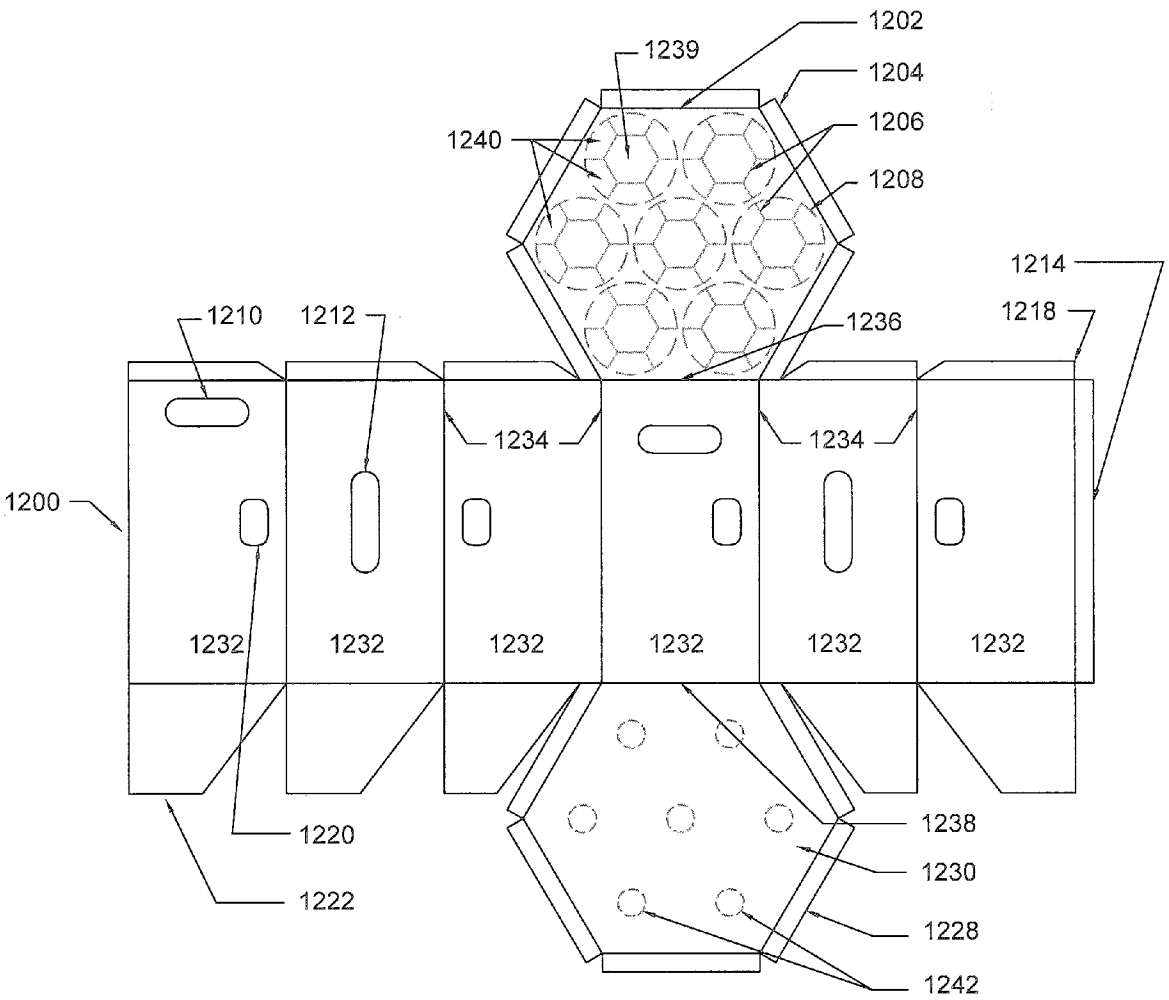
FIG. 12 shows another substantially flat blank that may be used to form a secondary package of the invention.

FIG. 3A depicts a pre-cut blank (300) that may be used to form a recessed lid at one end of the hexagonal secondary package of the invention. It should be understood that the top panel of the hexagonal secondary package of the invention (also referred to throughout this disclosure as a "lid") may be formed as a separate article to be mated with the hexagonal secondary package during production or distribution, or the top panel may be formed as one part of a blank, which is assembled to form a complete secondary package from one precut blank, as depicted in FIGS. 4, 11 and 12 of this disclosure. Additionally, it will be readily understood that such lid could be formed to fit on one end of another secondary package, such as a circular, square or rectangular package. As shown in FIG. 3, a plurality of slits (308) are cut in a hexagonal pattern that radiate outwardly from the center of openings (304) to define apertures (306) around the openings (304). The openings (304) preferably have a diameter (310) sized to be substantially equal to the diameter of a circle defined by the top of the intended primary package to be held and transported within the secondary package of the invention. The apertures (306) define a folding point for the slits (308), which allows for expansion of the openings (304) to permit removal of a primary package held within the secondary package. Thus, openings (304) preferably define a diameter that is slightly smaller than the diameter of the primary package intended to be carried in the secondary package, such that the lid (300) holds the primary package securely within the secondary package while in storage or transport. The outer most diameter (312) of the openings (304) is sufficiently large to allow the primary package held within the secondary package to pass through the opening (304) when a user removes a primary package from the secondary package. The precut blank (300) further comprises tabs (302) that form a connection point between the precut blank (300) and the side panel of the hexagonal secondary package of the invention, when the precut blank (300) is connected to one end of the hexagonal secondary package to form a recessed lid. The tabs (302) may be connected to the side panels of the hexagonal secondary package by any standard means including gluing, stapling, sewing, or the like.

FIG. 3B depicts a pre-cut blank (320) that may be used to form a recessed lid at one end of the hexagonal secondary package of the invention. A plurality of slits (328) are cut in a circular pattern that radiate outwardly from the center of openings (324) to define apertures (326) around the openings (324). The openings (324) preferably have a diameter (330) sized to be substantially equal to the diameter of a circle defined by the top of the intended primary package to be held and transported within the secondary package of the invention. The apertures (326) define a folding point for the slits (328), which allows for expansion of the openings (324) to permit removal of a primary package held within the secondary package. Thus, openings (324) preferably define a diameter that is slightly smaller than the diameter of the primary package intended to be carried in the secondary package, such that the lid (320) holds the primary package securely within the secondary package while in storage or transport. The outer most diameter (332) of the openings (324) is sufficiently large to allow the primary package held within the secondary package to pass through the opening (324) when a user removes a primary package from the secondary package. The precut blank (320) further comprises tabs (322) that form a connection point between the precut blank (320) and the side panel of the hexagonal secondary package of the invention, when the precut blank (320) is connected to one end of the hexagonal secondary package to form a recessed lid. The tabs (322) may be connected to the side panels of the hexagonal secondary package by standard means including gluing, stapling, sewing, or the like.

Figure 4A:
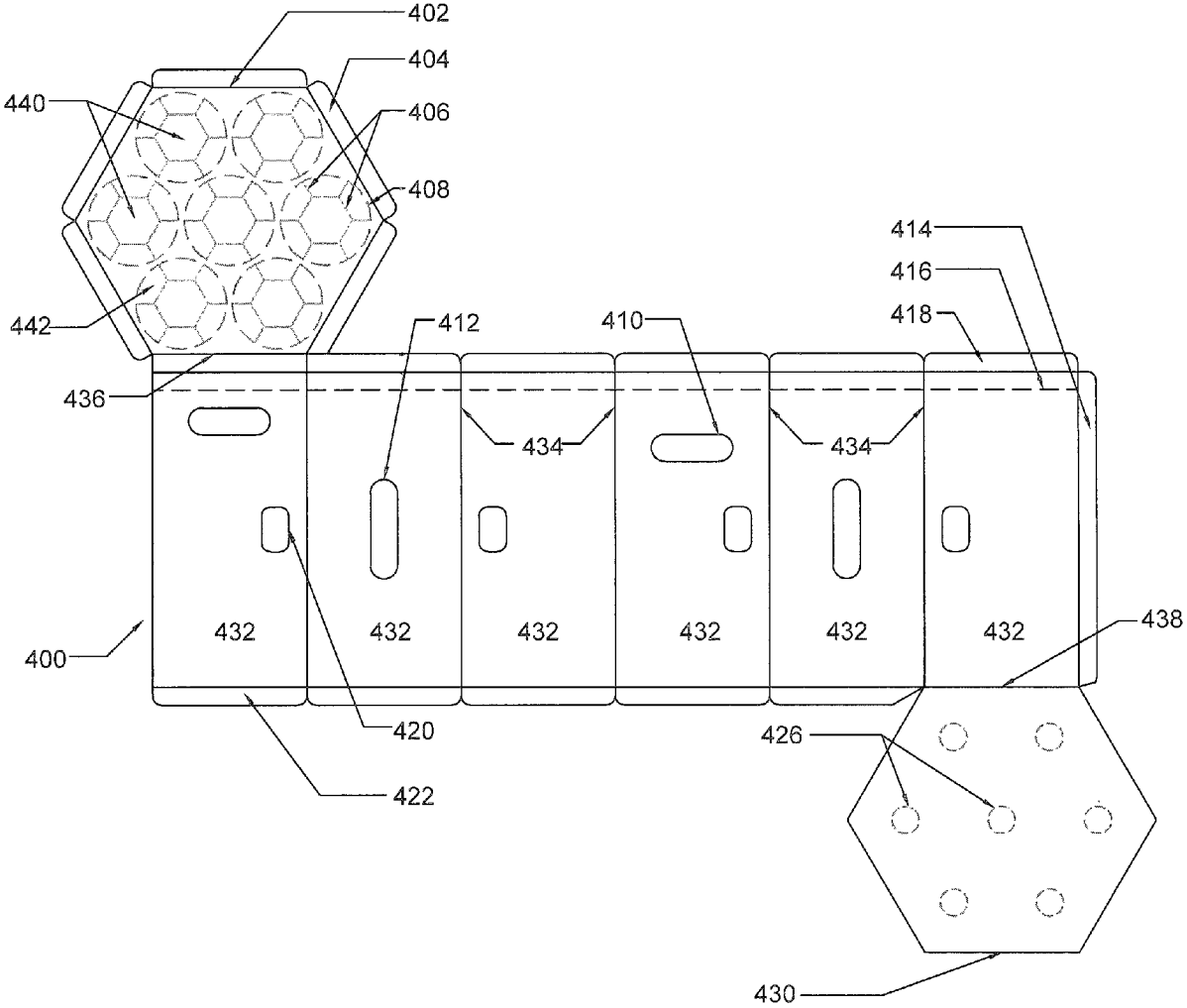
FIG. 4A shows a substantially flat blank that may be assembled to form a secondary package of the invention having a bottom panel flush with the ends of the side panels of the secondary package.

FIG. 4A depicts a plan view of a blank (400) that may be used to produce and form a hexagonal configuration of the secondary package of the invention, having a base that is flush with one end of the hexagonal tube. The secondary package blank (400) is a one-piece blank configured so that a secondary package may be formed from one-piece of material, such as cardboard/paperboard, plastic or the like. The blank (400) has lid (402) and a base (430) which form the top and bottom of the hexagonal tube that is formed from the secondary package blank (400). The six side panels (432) that make up the secondary package blank (400) are connected by fold lines (434). The side panels (432) contain openings (410, 412, 420) that may be used as handles to lift and carry the secondary package when the secondary package has been fully assembled from the secondary package blank (400). One of the openings (410) is located below the recessed lid line (416) proximate the top of the side panel (432), to allow a person carrying the secondary package assembled from the secondary package blank (400) to insert several fingers in opening (410) and lift the assembled hexagonal secondary package. The opening (412) is located at a mid-point on a side panel (432) and is similar in size to opening (410), although oriented parallel to the fold line (434). Such opening (412) is preferably located proximate another opening (420) on an adjacent side panel (432), such that a user may conveniently use the openings (412) and (420) to hold and transport the secondary package by inserting several fingers in opening (412) and a thumb of the same hand into opening (420). The lid (402) and base (430) are hingedly connected to side panels (432) by fold lines (436) and (438), respectively.

The lid (402) contains a plurality of slits (406) are cut in a hexagonal pattern that radiate outwardly towards the score ring (408) to define apertures (442) around openings (440). The apertures (442) define folding points created by hexagonal cuts (406), which allow for expansion of the openings (440) to permit removal of a primary package held within the secondary package. The score ring (408) of the openings (440) is sufficiently large to allow a primary package held within the secondary package to pass through the opening (440) when a user removes a primary package from the secondary package. The lid (402) is recessed within the top of the secondary package by connecting lid tabs (404) and top body tabs (418). The depth of the recess of the lid (402) within the top of the hexagonal tube, after assembly of the hexagonal tube from the secondary package blank (400), is depicted by recessed lid line (416).

The base (430) is provided with seven stabilizing posts (426) configured to align with and interlock with the base of one or more primary packages intended to be carried in the hexagonal secondary package formed from the secondary package blank (400).

The secondary package blank (400) further comprises tabs (404, 414, 418, 422) that form a connection point between edges of the secondary package blank (400) to allow for easy and efficient assembly of the secondary package blank (400) by connecting: side body tab (414) to opposing side panel (432), bottom body tab (422) to base (430), and lid tabs (404) to top body tabs (418). These tabs may be connected to form a hexagonal secondary package by any standard means including gluing, stapling, sewing, or the like.

Figure 4B:
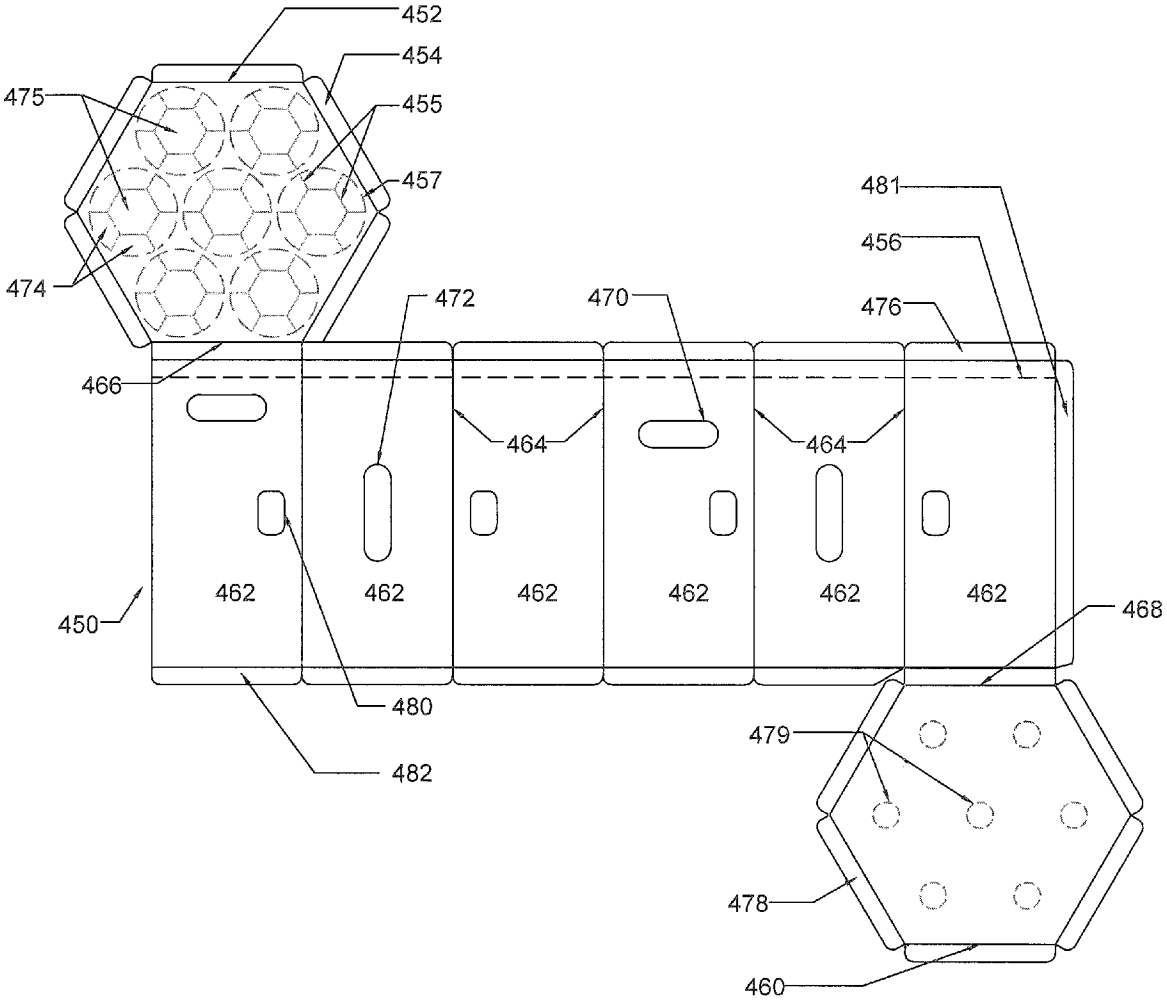
FIG. 4B shows a substantially flat blank that may be assembled to form a secondary package of the invention having a bottom panel recessed within one end of the secondary package.

FIG. 4B depicts a plan view of a blank (450) that may be used to produce and form a secondary package of the invention, having a base that is recessed within one end of the hexagonal tube. The secondary package blank (450) is a one-piece blank configured so that a secondary package may be formed from one-piece of material, such as cardboard/paperboard, plastic or the like. The blank (450) has lid (452) and a base (460) which form the top and bottom of the hexagonal tube that is formed from the secondary package blank (450). The six side panels (462) that make up the hexagonal secondary package blank (450) are connected by fold lines (464). The side panels (462) contain openings (470, 472, 480) that may be used as handles to lift and carry the secondary package when the secondary package has been fully assembled from the secondary package blank (450). One of the openings (470) is located below the recessed lid line (456) proximate the top of the side panel (462), to allow a person carrying the secondary package assembled from the secondary package blank (450) to insert several fingers in opening (470) and lift the assembled hexagonal secondary package. The opening (472) is located at a mid-point on a side panel (462) and is similar in size to opening (470), although oriented parallel to the fold line (464). Such opening (472) is preferably located proximate another opening (480) on an adjacent side panel (432), such that a user may conveniently use the openings (472) and (480) to hold and transport the secondary package by inserting several fingers into opening (472) and a thumb of the same hand into opening (480). The lid (452) and base (460) are hingedly connected to side panels (432) by fold lines (466) and (468), respectively.

The lid (452) contains a plurality of hexagonal cuts (455) cut in a hexagonal pattern that radiate outwardly towards a score ring (457) to define apertures (474) around openings (475). The apertures (444) define folding points created by hexagonal cuts (455), which allow for expansion of the openings (475) to permit removal of a primary package held within the secondary package. The score ring (457) of the openings (475) is sufficiently large to allow a primary package held within the secondary package to pass through the opening (475) when a user removes a primary package from the secondary package. The lid (452) is recessed within the top of the secondary package by connecting lid tabs (454) and top body tabs (476). The depth of the recess of the lid (452) within the top of the hexagonal tube, after assembly of the hexagonal sleeve from the secondary package blank (450), is depicted by recessed lid line (456).

The base (460) is provided with seven stabilizing posts (479) configured to align with and interlock with the base of one or more primary packages intended to be carried in the hexagonal secondary package formed from the secondary package blank (450). The base (460) is recessed within the bottom of the secondary package by connecting bottom body tabs (482) and base tabs (478).

The secondary package blank (450) further comprises tabs (454, 481, 476, 482) that form a connection point between edges of the secondary package blank (450) to allow for easy and efficient assembly of the secondary package blank (450) by connecting: side body tab (481) to opposing side panel (462), bottom body tabs (482) to base tabs (478), and lid tabs (454) to top body tabs (476). These tabs may be connected to form the hexagonal secondary package by any standard means including gluing, stapling, sewing, or the like.

Figure 4C:
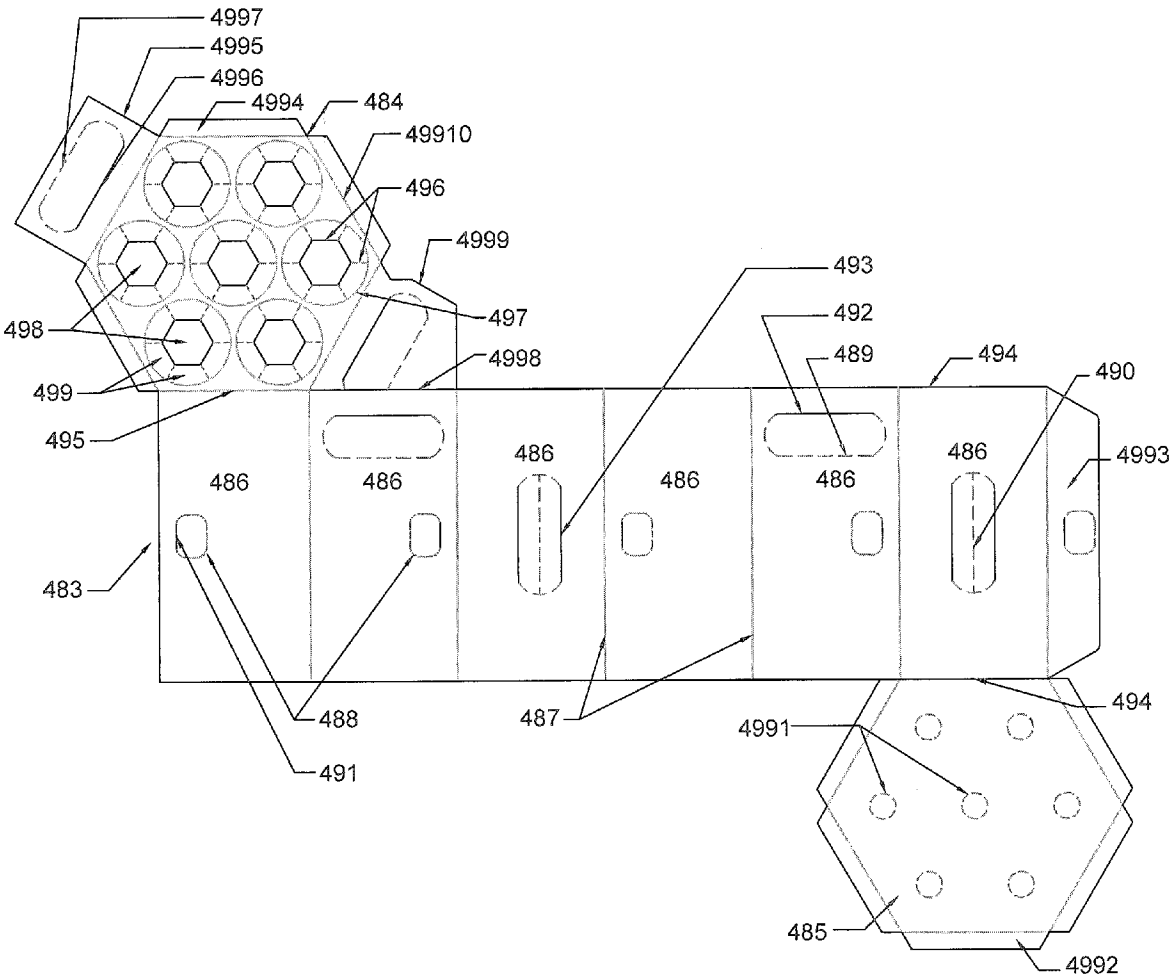
FIG. 4C shows a plan view of a secondary package blank that may be used to produce and form a hexagonal secondary package of the invention.
Figure 4D:
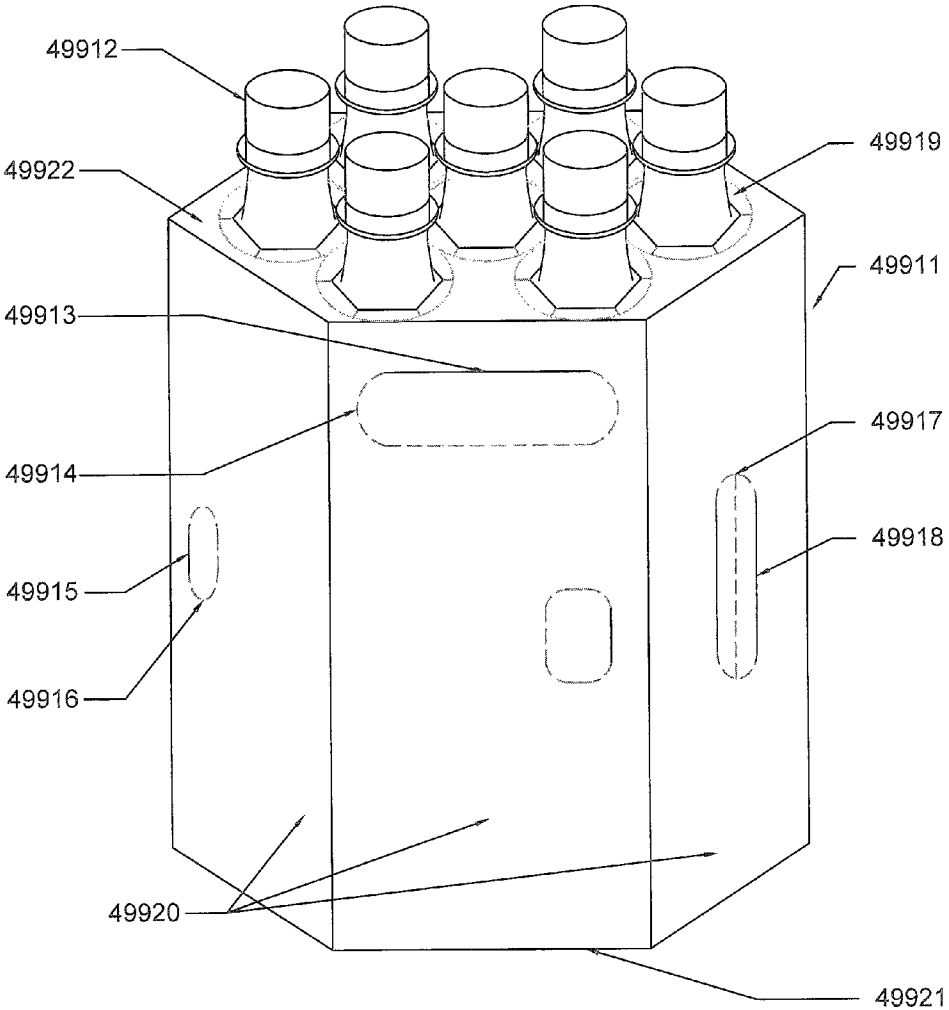
FIG. 4D shows a multi-compartmented hexagonal secondary package of the invention.

FIG. 4C depicts a plan view of a secondary package blank (483) that may be used to produce and form a hexagonal secondary package of the invention, having a sturdier handle that formed from an overlap of two portions of the assembled blank (depicted in FIG. 4D). The secondary package blank (483) is a one-piece blank configured so that a secondary package may be formed from one-piece of material, such as cardboard/paperboard, plastic or the like. The blank (483) has lid (484) and a base (485) which form the top and bottom of a hexagonal tube that is formed from the secondary package blank (483). The lid (484) and base (4485) are hingedly connected to side panels (486) by fold lines (495) and (494), respectively.

The six side panels (486) that make up the hexagonal secondary package blank (483) are connected by fold lines (487). The side panels (486) contain die-cuts to form punch-in openings (488, 489, 490) that may be used as handles to lift and carry the secondary package when the secondary package has been fully assembled from the secondary package blank (483). Each of the die cuts (488, 489, 490) is configured with a score line (491, 492, 493) for forming the punch-in openings. Die cut (489) and score line (492) are located below the lid line (494) proximate the top of the side panel (486), to allow a person carrying the secondary package assembled from the secondary package blank (483) to punch in the die cut (489) with several fingers and lift the assembled hexagonal secondary package. Another die cut (490) and score line (493) combination is located in at least one side panel (486) to allow a person carrying the secondary package assembled from the secondary package blank (483) to punch in the die cut (490) with several fingers and lift the assembled hexagonal secondary package. Another die cut (488) and score line (491) combination is located in at least one side panel (486), adjacent a side panel having die cut (490) and score line (493) combination, thereby allowing a person carrying the secondary package assembled from the secondary package blank (483) to punch in the die cut (488) with one finger and lift the assembled hexagonal secondary package by inserting one or more fingers in an opening created by die cut (490) and opposing thumb in an opening created by die cut (488).

The lid (484) contains a plurality of hexagonal cuts (496) cut in a hexagonal pattern that radiate outwardly towards a score ring (497) to define apertures (499) around openings (498). The apertures (499) define folding points created by hexagonal cuts (496), which allow for expansion of the openings (498) to permit removal of a circular primary package held within the secondary package. The score ring (497) of the openings (498) is sufficiently large to allow a primary package held within the secondary package to pass through the opening (498) when a user removes a primary package from the secondary package. The lid (484) includes two handle overlap flaps (4995 and 4999), configured to overlap die cut (489) and score line (492) in side panels (486) such that a person carrying the secondary package assembled from the secondary package blank (483) can punch in the die cuts (489 and 4997) with several fingers and lift the assembled hexagonal secondary package. This overlap between the side panels (486) and one of the handle overlap flaps (4995 and 4999) substantially strengthens the handle formed by punching in the die cuts (489 and 4997) for more stable and sturdy carrying of the secondary package assembled from the secondary package blank (483). Handle overlap flap (4995) is folded along one score line (49910) around sides of the lid (484). A second handle overlap flap (4999) is also folded one score line (49910) around sides of the lid (484), but secondary package blank (483) contains a slit line (4998) that allows the second handle overlap flap (4999) to slide over or under an adjacent side panel (486) upon assembly of the secondary package from the secondary package blank (483).

The base (485) is provided with seven stabilizing posts (4991) configured to align with and interlock with the base of one or more primary packages intended to be carried in the hexagonal secondary package formed from the secondary package blank (483).

The secondary package blank (483) further comprises tabs (4992, 4993, 4994) that form a connection point between edges of the secondary package blank (483) to allow for easy and efficient assembly of the secondary package blank (483) by connecting: side body tab (4993) to opposing side panel (486), base tabs (4992) to side panels (486), and lid tabs (4994) to side panels (486). These tabs may be connected to form the hexagonal secondary package by any standard means including gluing, stapling, sewing, or the like.

FIG. 4D depicts a multi-compartmented hexagonal secondary package (49911) assembled from a secondary package blank. The assembled package (49911) comprising seven interior compartments configured to hold primary packages (49912) of materials, particularly liquids. The assembled secondary package (49911) is formed in a hexagonal shape composed of six side panels (49920), closed at one end with a base (49921) and shown loaded with seven primary packages (49912) projecting through openings (49919) in a lid (49922), which closes the opposing end of the hexagonal secondary package. As shown, the primary packages (49912) within the secondary package (49911) are shown arranged in a hexagonal pattern with one primary package located at a central compartment.

The embodiment of the secondary package (49911) depicted in FIG. 4D is formed with die-cut openings that may be punched in to form a handle that may be used to hold and carry the secondary package and its contents. One of the die cuts (49914) and corresponding score lines (49913) are located below the lid (49922) proximate the top of a panel (49920). The handle that is formed from the die cuts (49914) and corresponding score lines (49913) is preferably of sufficient size to accommodate at least three fingers of a person carrying the secondary package (49911).

Another die-cut (49917) and corresponding score line (49918) combination is located at a mid-point on a side panel (49920) and are similar in size to die cuts (49914) and corresponding score lines (49913) located proximate the lid (49922), although oriented perpendicular to the lid (49922). Such die-cut (49917) and corresponding score line (49918) combination is preferably located proximate another die-cut (49916) and corresponding score line (49915) combination on an adjacent side panel (49920). Such die-cut (49916) and corresponding score line (49915) combination is preferably of sufficient size to accommodate at least one finger of a person carrying the secondary package (49911). In this orientation, a user may conveniently punch in the die cuts (49917 and 49916) to hold and transport the secondary package (49911) by inserting several fingers to die cut (49917) and a thumb of the same hand into opposing die cut (49916).

Figure 5:
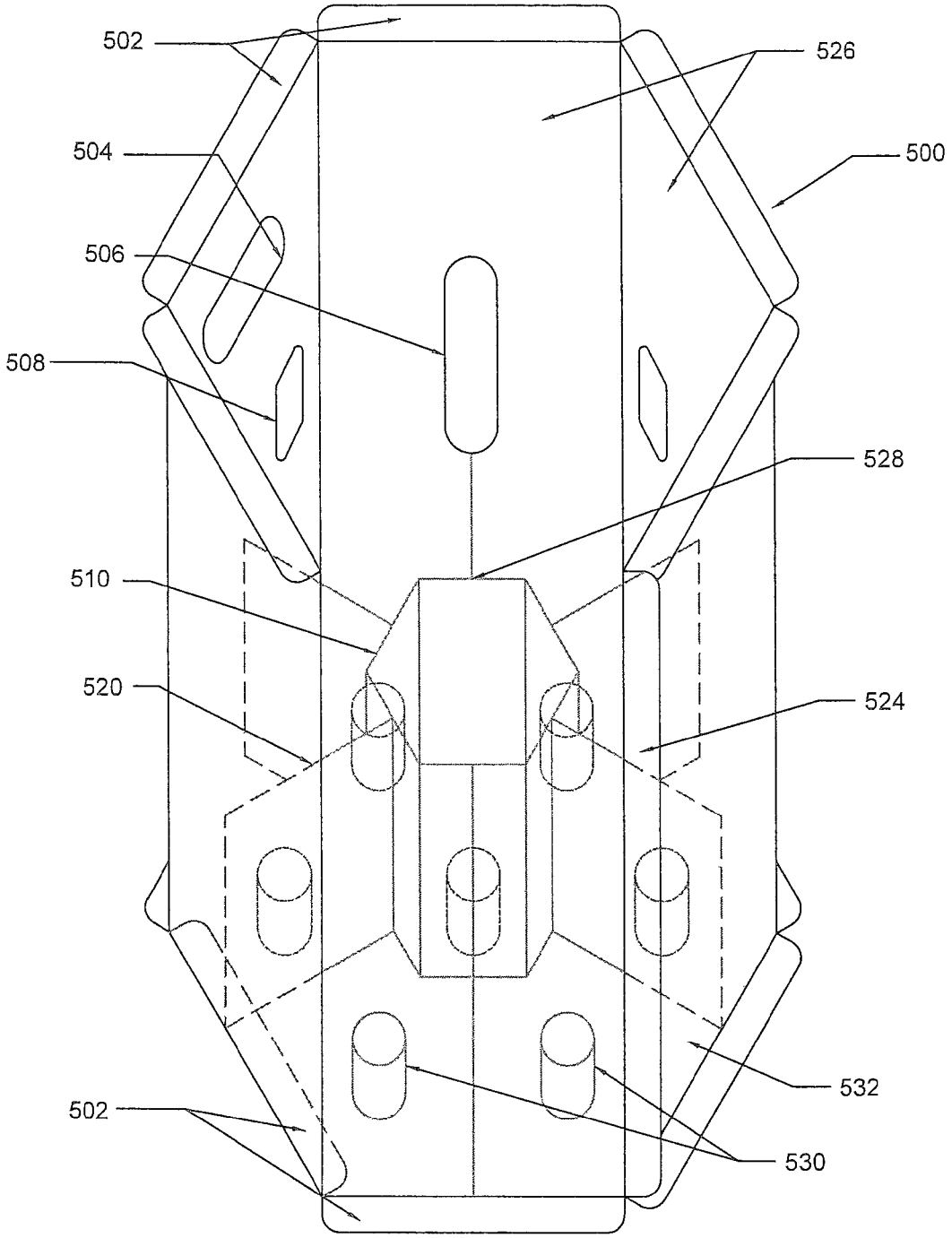
FIG. 5 shows an exploded view of a secondary package according to the present invention.

FIG. 5 shows an exploded view of a secondary package (500) of the present invention. Body tabs (502) are positioned around the top and bottom of the side panels (526). Body tabs (502) are configured to connect with corresponding tabs and/or the surface of the lid and base of the fully assembled hexagonal secondary package of the invention depicted in FIG. 5. Openings (504, 506, 508) may be used as handles to lift and carry the fully assembled secondary package (500). One of the openings (504) is preferably located below the lid, proximate the top of one or more side panels (526), to allow a person carrying the secondary package to insert several fingers in opening (504) and lift the assembled secondary package (500). The opening (506) is located at a mid-point on a side panel (526) and is similar in size to opening (504), although oriented perpendicular to opening (504) and on adjacent side panels (526). Such opening (506) is preferably located proximate another opening (508) on an adjacent side panel, such that a user may conveniently use the openings (506) and (508) to hold and transport the secondary package by inserting several fingers in opening (506) and a thumb of the same hand into opening (508).

FIG. 5 also depicts an internal stabilizing member (528), including a hexagonal central hub (510), and at least four interior stabilizer arms (520) radiating from the central hub (510). The central hub (510) serves to strengthen and stabilize the secondary package when fully assembled, and may also function to separate primary packages contained within the secondary package (500).

FIG. 5 also depicts stabilizing posts 530 placed on thdne base 532 to reversibly interlock with primary packages in the assembled secondary package.

Figure 6:
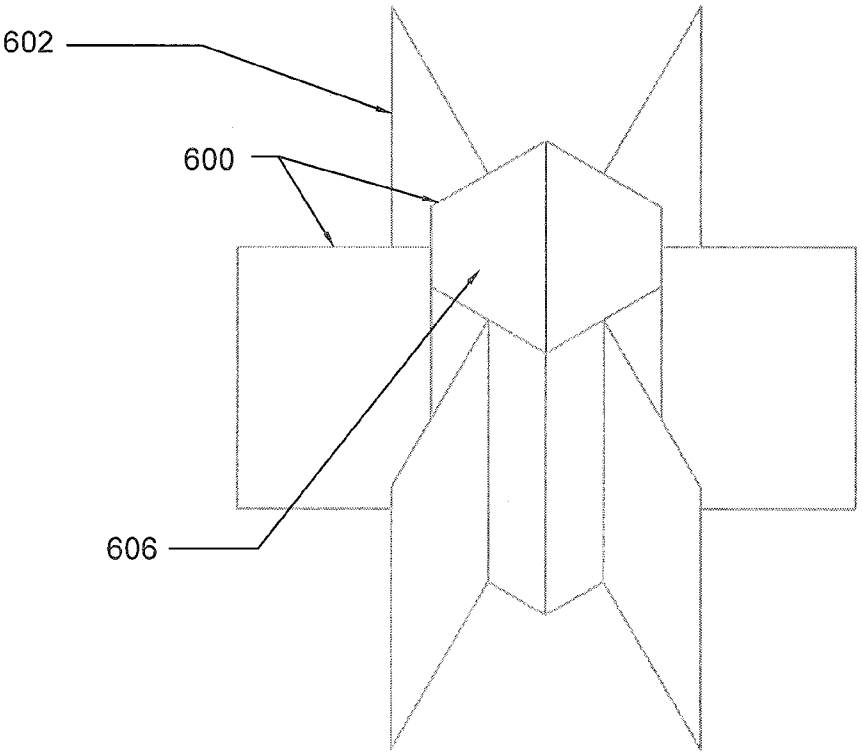
FIG. 6 is a top plan view of an internal stabilizing member according to the invention.

FIG. 6 shows one embodiment of an internal stabilizing member (600) for use within the hexagonal secondary package of the present invention. This internal stabilizing member (600) is composed of a central hub (606) having a hexagonal shape, with six arms (602) connected to and radiating from each of the six sides forming the hexagonal central hub (606). In a related embodiment, an internal stabilizing member is provided similar to the internal stabilizing member (600) depicted in FIG. 6, but having a central hub that is circular in shape. In each case, the arms (602) radiating from the central hub serve to strengthen the hexagonal secondary package when the internal stabilizing member is deployed within the fully assembled hexagonal secondary package of the invention. These arms may also serve to completely or partially separate primary packages held within the secondary package of the invention.

Figure 7:
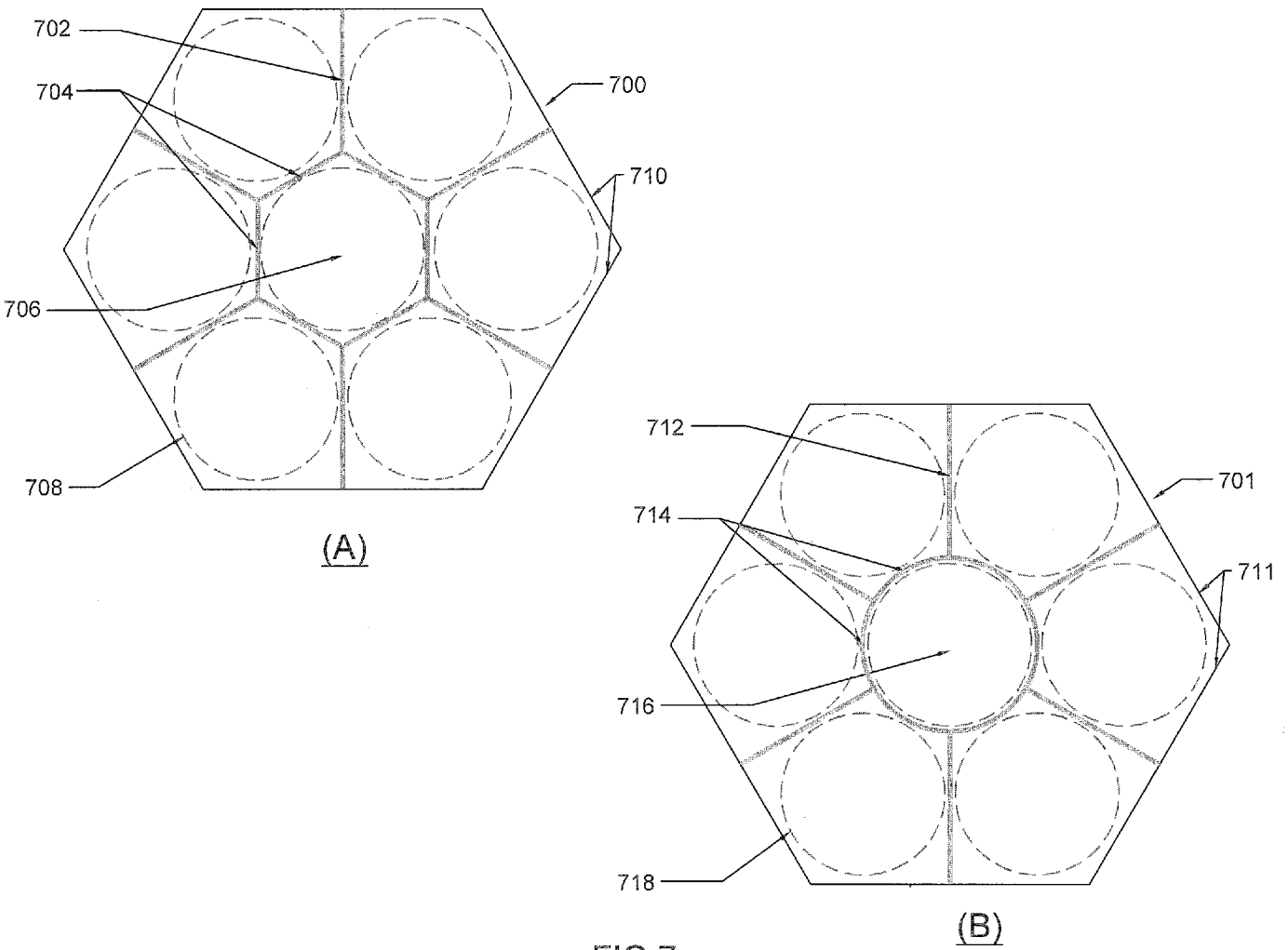
FIG. 7A is a top view of the secondary package of FIG. 1 showing an internal stabilizing member in place in the secondary package.
FIG. 7B is a top view of the secondary package of FIG. 1 showing another internal stabilizing member in place in the secondary package.

FIG. 7A is a top view of the interior stabilizing member (704) deployed in a hexagonal secondary package (700) of the invention. Interior stabilizing member (704) is hexagonal in shape, and has six arms radiating from each of the six points of the hexagon forming the central hub (706), and extending to the side panels (710) of the hexagonal secondary package (700). In this configuration, internal stabilizing member (704) deployed in the hexagonal secondary package (700) forms seven interior compartments with a central hub compartment (706) being hexagonal in shape, offset from the sides (710) of the secondary package, with each of the outer pockets comprising pentagonal figures, the apex of which is formed by the corners of the secondary package (700). The configuration and placement of seven circular primary packages arranged within the hexagonal secondary package (700) and separated by the internal stabilizing member (704), including each of the arms (702), is depicted by circular dashed lines (708). In this configuration, the internal stabilizing members act to completely or partially separate primary packages held within the secondary package (700), and to strengthen and stabilize the shape and form of the hexagonal secondary package (700). The strength and stability of the secondary packaging of the present invention allows for the removal of one or more primary packages without destabilizing or collapsing the secondary packaging and without diminishing a user's ability to lift and transport primary packages remaining within the secondary packaging.

FIG. 7B is a top view of the interior stabilizing member (714) deployed in a hexagonal secondary package (701) of the invention. Interior stabilizing member (714) has a circular central hub (716), and has six arms (712) radiating from the circumference of the circle forming the central hub (716), and extending to the side panels (711) of the hexagonal secondary package (701). In this configuration, internal stabilizing member (714) deployed in the hexagonal secondary package (701) forms seven interior compartments with a central hub compartment (716) being circular in shape, offset from the sides (711) of the secondary package. The configuration and placement of seven primary packages arranged within the hexagonal secondary package (701) and separated by the internal stabilizing member (714), including each of the arms (712), is depicted by circular dashed lines (718). In this configuration, the internal stabilizing member (714), including arms (712), act to completely or partially separate primary packages held within the secondary package (701), and to strengthen and stabilize the shape and form of the hexagonal secondary package (701).

Figure 8:
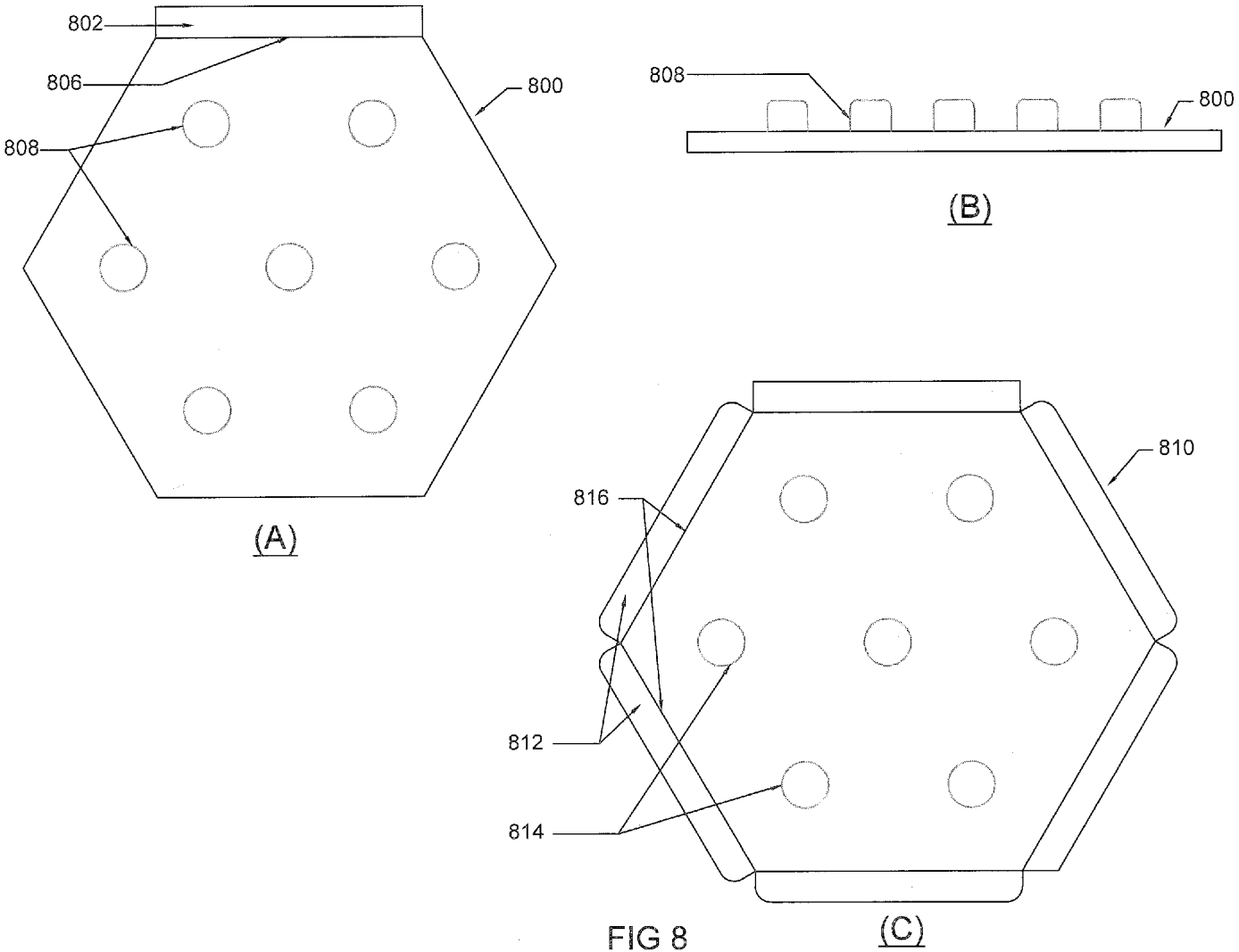
FIG. 8A is a top view of a bottom panel for use in the secondary packages of the present invention.
FIG. 8B is a front elevation view of the bottom panel of FIG. 8A.
FIG. 8C is a top view of another bottom panel for use in the secondary packages of the present invention.

FIG. 8A shows a top view of a bottom panel that may form the base of a hexagonal secondary package of the invention. Base (800) includes one base tab (802) connected to the base at a fold line (806). The base tab (802) is configured to attach to one end of the hexagonal secondary package of the invention. Seven stabilizing posts (808) are arranged on the base (800) and configured to interlock with and support primary packages located within the secondary package, such as the primary package shown in FIG. 13.

FIG. 8B shows a front elevation view of the base of FIG. 8A. Stabilizing posts (808) extend from the material forming the base (800). The posts may be composed of the same material used to form the base (800) or may be composed of a different material, such as a plastic, polymer, rubber, wood, and the like.

FIG. 8C also shows a top view of a bottom panel that may form the base of a hexagonal secondary package of the invention. Base (810) includes six base tabs (812) connected to the base at fold lines (816). These base tabs (812) are configured to attach to one end of the hexagonal secondary package of the invention. The configuration and placement of seven stabilizing posts (814) arranged on the base (810). Seven stabilizing posts (814) are arranged on the base (810) and configured to interlock with and support primary packages located within the secondary package, such as the primary package shown in FIG. 13.

Figure 9:
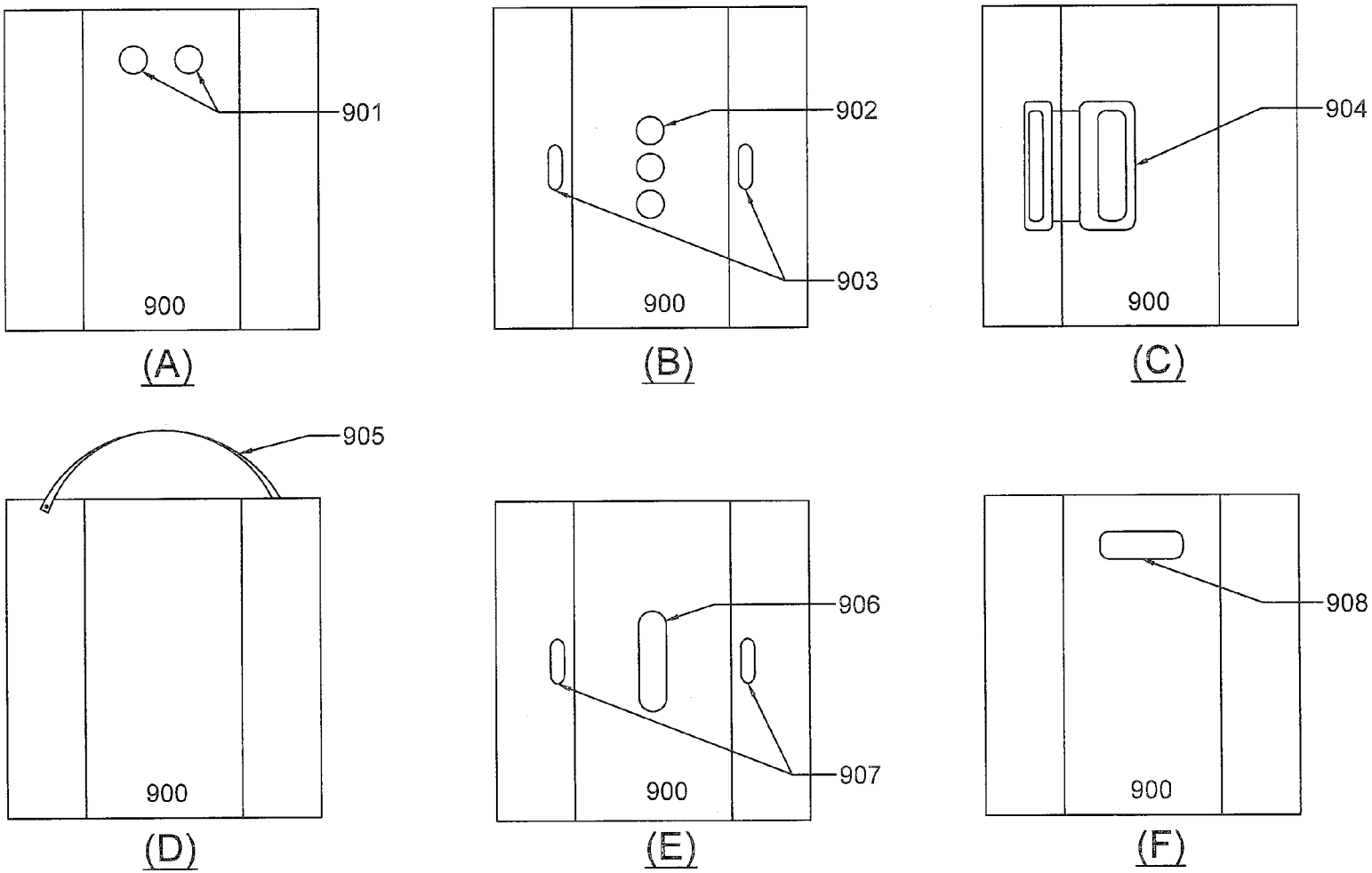
FIG. 9A-9F are side elevational views of embodiments of the secondary package of the invention provided with handle or finger hole configurations.

FIGS. 9A-9F depict six configurations of handles that may be used to hold and transport the secondary package of the invention. FIG. 9A depicts two openings (901) in a sidewall (900) of a secondary package of the invention. These two openings may be used to carry the secondary package by inserting two fingers into each of the respective holes and clasping the hand of the user around one edge of the secondary package. In another embodiment, FIG. 9B depicts three openings (902) in a sidewall (900) of a secondary package, and one openings (903) in an adjacent sidewall of the secondary package. These openings may be used to carry the secondary package by inserting three fingers into holes (902), and a thumb from the same hand into either hole (903), such that the user can clasp the secondary package in one hand—either left or right. FIG. 9C depicts a handle (904) attached to one or more sidewalls (900) of a secondary package. In this embodiment, a user may hold or carry the secondary package by clasping the handle (904) with one hand—either left or right. FIG. 9D shows a secondary package of the present invention having a strap handle (905) attached at one end of the secondary package. In this embodiment, user may carry the secondary package in a substantially upright position by clasping the strap handle (905). FIG. 9E, depicts an embodiment in which a sidewall contains an elongated opening (906) and two smaller elongated openings (907). In this embodiment, a user may lift or carry the secondary package by placing several fingers in the elongated opening (906), and a thumb from the same hand into either of the smaller elongated openings (907). The user can thereby easily and comfortably carry the secondary package of the invention in one hand. FIG. 9F, depicts a secondary package of the invention having an elongated opening (908), which may be used to carry the secondary package. When a user inserts several fingers into opening (908) and clasps the user's hand around the end of the secondary package, the user can easily and comfortably lift and carry the secondary package of the invention.

Figure 10:
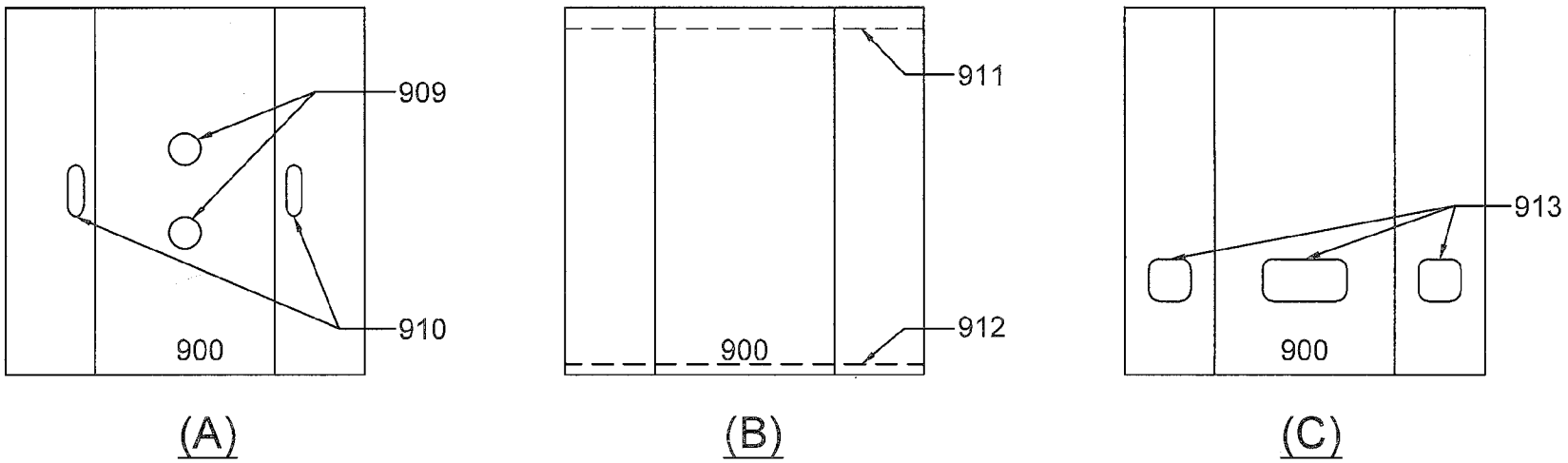
FIG. 10A is a side elevational view of an embodiment of the secondary package of the invention provided with a finger hole configuration.
FIG. 10B is a side elevational view of an embodiment of the secondary package of the invention having a recessed compartment base.
FIG. 10C is a side elevational view of an embodiment of the secondary package of the invention having holes that provide access to a portion of the internal contents of the secondary package.

FIG. 10A depicts another configuration of openings that may be used to lift and transport a secondary package of the invention. In this embodiment, two openings (909) are formed in a sidewall (900) of the secondary package and elongate openings (910) are formed in one or more adjacent sidewalls (900). In this configuration, the secondary package of the invention may be lifted or transported by inserting a finger in each of openings (909) and a thumb of the same hand into elongate opening (910). FIG. 10B depicts a secondary package of the invention having a recessed lid and base. The depth of the recessed lid is depicted by dashed line (911). The depth of the recessed base is depicted by dashed line (912). FIG. 10C depicts one embodiment of the secondary package of the invention having openings (913) that may be used to view the contents or packaging contained within the hexagonal secondary package of the invention.

FIG. 11 depicts a plan view of a blank (1100) that may be used to produce and form a hexagonal secondary package of the present invention. The secondary package blank (1100) is a one-piece blank so that the secondary package is formed from one-piece of material, such as cardboard/paperboard, plastic or the like. The blank (1100) has lid (1102) and a base (1130) which formed the top and bottom of the hexagonal secondary package that is formed from the secondary package blank (1100). The six side panels (1132) that make up the secondary package blank (1100) are connected by fold lines (1134). The side panels (1132) contain openings (1110, 1112, 1120) that may be used as handles to lift and carry the secondary package when the secondary package has been fully assembled from the secondary package blank (1100). One of the openings (1110) is located below the lid (1102) proximate the top of the side panel (1132), to allow a person carrying the secondary package assembled from secondary package blank (1100) to insert several fingers in opening (1110) and lift the assembled hexagonal secondary package. The opening (1112) is located at a mid-point on a side panel (1132) and is similar in size to opening (1110), although oriented parallel to the fold line (1134). Such opening (1112) is preferably located proximate another opening (1120) on an adjacent side panel (1132), such that a user may conveniently use the openings (1112) and (1120) to hold and transport the secondary package by inserting several fingers in opening (1112) and a thumb of the same hand into opening (1120). The lid (1102) and base (1130) are hingedly connected to the opposing side panels (1132) by fold lines (1136) and (1138), respectively.

The lid (1102) contains a plurality of slits (1106) cut in a hexagonal pattern that radiate outwardly towards the score ring (1108) to define apertures (1140) around openings (1139). The apertures (1140) defined by hexagonal cuts (1106), which allows for expansion of the openings (1139) to permit removal of a primary package held within the secondary package. The score ring (1108) of the openings (1139) is sufficiently large to allow the bottom of a primary package held within the secondary package to pass through the opening (1139) when a user removes a primary package from the secondary package.

The secondary package blank (1100) further comprises tabs (1104, 1114, 1118, 1122, 1128) that form a connection point between edges of the secondary package blank (1100) to allow for easy and efficient assembly of the secondary package blank (1100) by connecting: side body tab (1114) to opposing side panel (1132), base tabs (1128) to bottom body tab (1122), and lid tabs (1104) to top body tab (1118). These tabs may be connected to form a hexagonal secondary package by any standard means including gluing, stapling, sewing, or the like.

FIG. 12 depicts a plan view of another blank (1200) that may be used to produce and form a hexagonal secondary package of the present invention. The secondary package blank (1200) is a one-piece blank so that the secondary package is formed from one-piece of material, such as cardboard/paperboard, plastic or the like. The blank (1200) has lid (1202) and a base (1230) which formed the top and bottom of the hexagonal secondary package that is formed from the secondary package blank (1200). The six side panels (1232) that make up the secondary package blank (1200) are connected by fold lines (1234). The side panels (1232) contain openings (1210, 1212, 1220) that may be used as handles to lift and carry the secondary package when the secondary package has been fully assembled from the secondary package blank (1200). One of the openings (1210) is located below the lid (1202) proximate the top of the side panel (1232), to allow a person carrying the secondary package assembled from secondary package blank (1200) to insert several fingers in opening (1210) and lift the assembled hexagonal secondary package. The opening (1212) is located at a mid-point on a side panel (1232) and is similar in size to opening (1210), although oriented parallel to the fold line (1234). Such opening (1212) is preferably located proximate another opening (1220) on an adjacent side panel (1232), such that a user may conveniently use the openings (1212) and (1220) to hold and transport the secondary package by inserting several fingers in opening (1212) and a thumb of the same hand into opening (1220). The lid (1202) and base (1230) are hingedly connected to the opposing side panels (1232) by fold lines (1236) and (1238), respectively.

The lid (1202) contains a plurality of slits (1206) cut in a hexagonal pattern that radiate outwardly towards the score ring (1208) to define apertures (1240) around openings (1239). The apertures (1240) defined by hexagonal cuts (1206), allow for expansion of the openings (1239) to permit removal of a primary package held within the secondary package. The score ring (1208) of the openings is sufficiently large to allow the bottom of a primary package held within the secondary package to pass through the opening (1239) when a user removes a primary package from the secondary package.

The secondary package blank (1200) further comprises tabs (1204, 1214, 1218, 1222, 1228) that form a connection point between edges of the secondary package blank (1200) to allow for easy and efficient assembly of the secondary package blank (1200) by connecting: side body tab (1214) to opposing side panel (1232), base tabs (1228) to bottom body tab (1222), and lid tabs (1204) to top body tab (1218). These tabs may be connected to form the hexagonal secondary package by any standard means including gluing, stapling, sewing, or the like.

The base (1230) contains seven stabilizing posts (1242) arranged in a hexagonal pattern corresponding to the configuration and placement of seven primary packages that may be disposed in the secondary package and arranged against the base (1230). The stabilizing posts (1242) are configured and placed on the base to reversibly interlock with primary packages in the assembled secondary package formed from the secondary package blank (1200).

Figure 13:
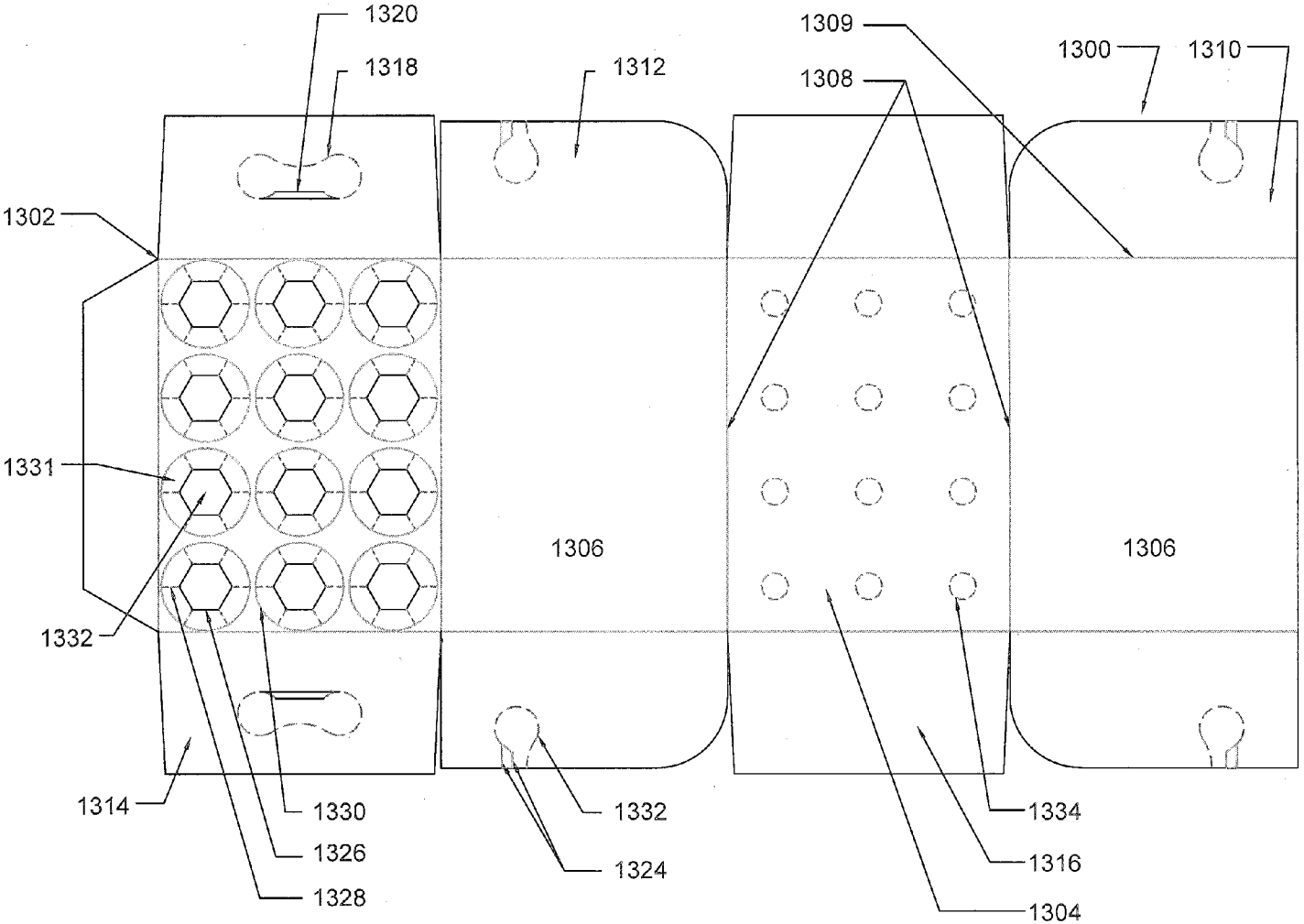
FIG. 13 shows another substantially flat blank that may be assembled to form a secondary package of the invention.

FIG. 13 depicts a plan view of a secondary package blank (1300) that may be used to produce and form a rectangular secondary package of the invention, configured to hold and secure twelve primary packages. The secondary package blank (1300) is a one-piece blank that may be formed from one-piece of material, such as cardboard/paperboard, plastic or the like. The blank (1300) has lid (1302) and a base (1304) which form the top and bottom of a rectangular container that is formed from the secondary package blank (1300). The lid (1302) and base (1304) are hingedly connected to side panels (1306) by fold lines (1308).

The side panels (1306) that make up the rectangular secondary package blank (1300) are connected by fold lines (1308). The side panels (1306) include flaps (1310, 1312, 1314, 1316) connected by fold lines (1309). Flaps (1314) contain die-cuts (1318) to form punch-in openings that may be used as handles to lift and carry the secondary package when the secondary package has been fully assembled from the secondary package blank (1300). The die cuts (1318) are configured with a score line (1320) for forming punch-in openings. Die cut (1318) and score line (1320) are located on flap (1314) attached to lid (1302) and allow a person carrying the rectangular secondary package assembled from the secondary package blank (1300) to punch in the die cut (1318) with several fingers and lift or hold the assembled rectangular secondary package. Another die cut (1322) and score line (1324) combination is located on a flap (1312) of at least one side panel (1306). This die cut (1322) and score line (1324) combination is located and configured to overlap die cut (1318) and score line (1320), located on flap (1314) attached to lid (1302), when the secondary package has been fully assembled from the secondary package blank (1300). This allows a person carrying the secondary package assembled from the secondary package blank (1300) to punch in the overlapping die cuts (1318 and 1322) with several fingers and lift the assembled rectangular secondary package.

The lid (1302) contains a plurality of hexagonal cuts (1326) adjacent perforations (1328) formed in a pattern radiating outwardly towards a circular score ring (1330) to define apertures (1331) around openings (1332). The apertures (1331) define folding points created by cuts (1326), which allow for expansion of the openings (1332) to permit removal of a circular primary package held within the secondary package. The score ring (1330) of the openings (1332) is sufficiently large to allow a primary package held within the secondary package to pass through the opening (1332) when a user removes a primary package from the secondary package.

The base (1304) is provided with twelve stabilizing posts (1334) configured to align with and interlock with the base of one or more primary packages intended to be carried in the rectangular secondary package formed from the secondary package blank (1300).

Flaps (1310, 1312, 1314, 1316) form a connection point between side panels (1306), top (1302) and base (1304) of the rectangular secondary package allowing for easy and efficient assembly of the secondary package from the secondary package blank (1300). These tabs may be connected to form the rectangular secondary package by any standard means including gluing, stapling, sewing, or the like.

Figure 14A:
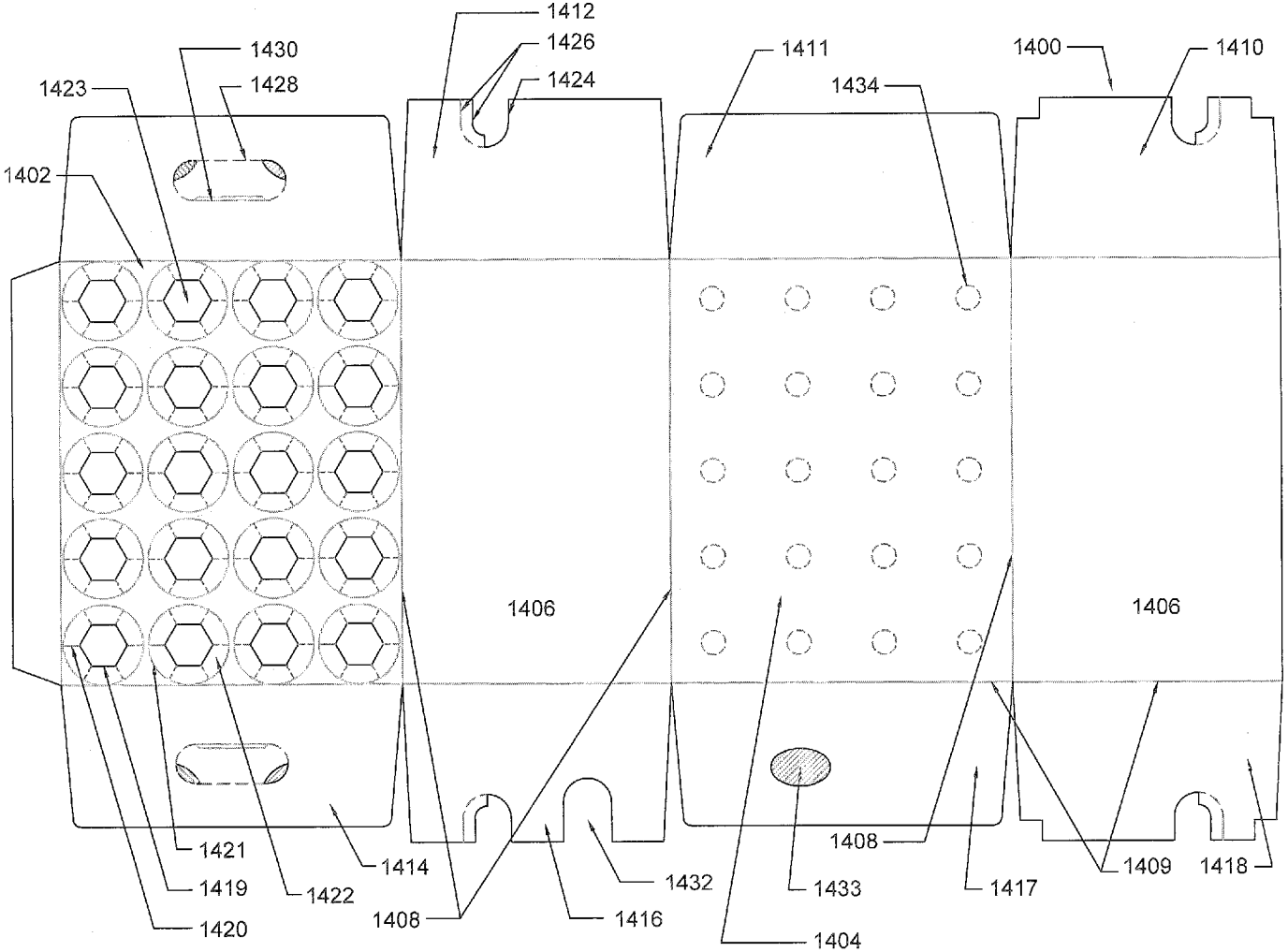
FIG. 14A shows a substantially flat blank that may be assembled to form a secondary package of the invention depicted in FIG. 14C, having a rectangular shape and handles on at least two sides of assembled secondary package.
Figure 14:
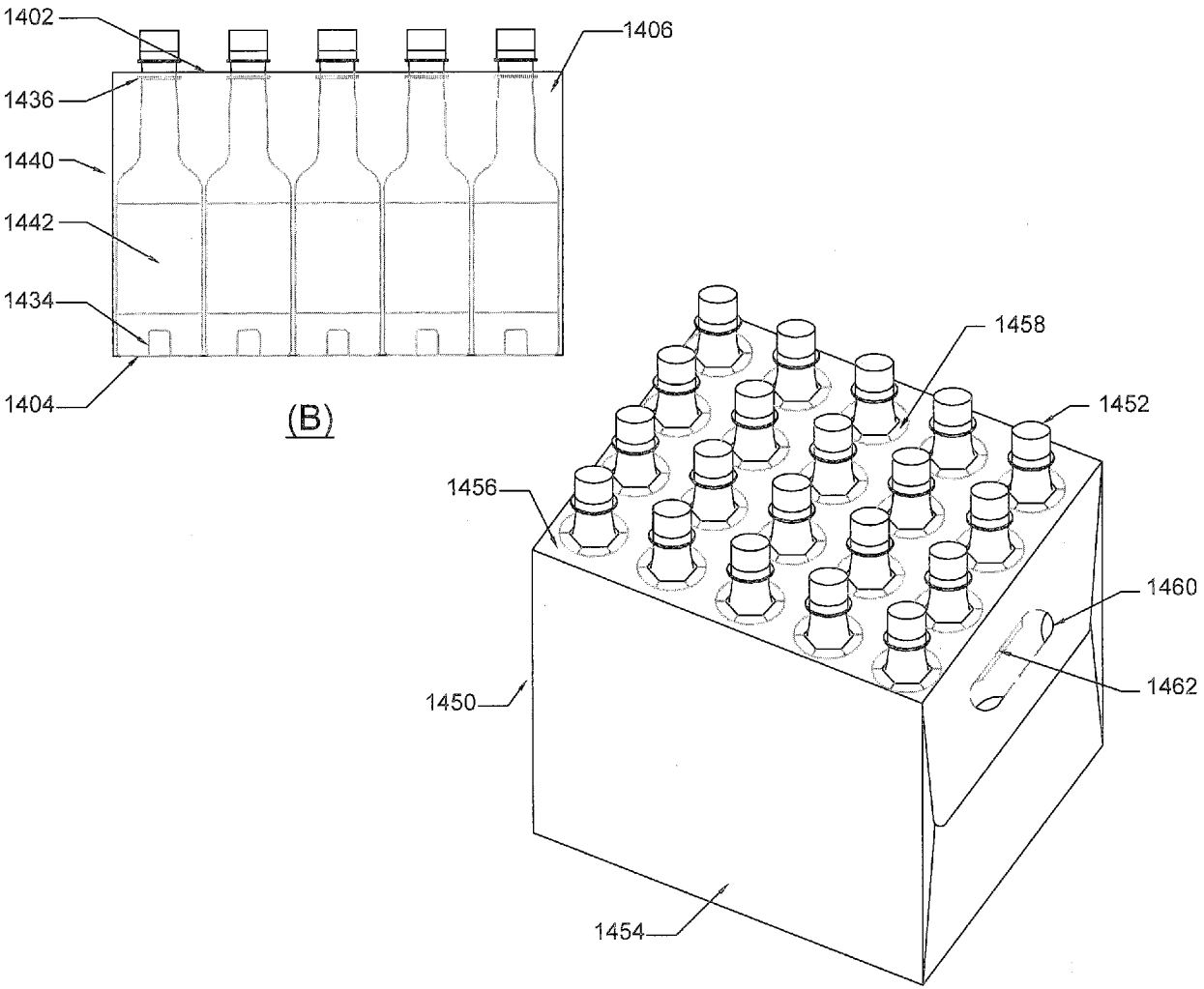
FIG. 14 depicts another embodiment of the secondary package of the present invention configured to securely hold 20 primary packages.

FIG. 14A depicts a plan view of a secondary package blank (1400) that may be used to produce and form a rectangular secondary package of the invention, configured to hold and secure twenty primary packages. The secondary package blank (1400) is a one-piece blank that may be formed from one-piece of material, such as cardboard/paperboard, plastic or the like. The blank (1400) has lid (1402) and a base (1404) which form the top and bottom of a rectangular container that is formed from the secondary package blank (1400). The lid (1402) and base (1404) are hingedly connected to side panels (1406) by fold lines (1408).

The lid (1402) contains a plurality of hexagonal cuts (1419) adjacent perforations (1420) formed in a pattern radiating outwardly towards a circular score ring (1421) to define apertures (1422) around openings (1423). The apertures (1422) define folding points created by cuts (1419), which allow for expansion of the openings (1423) to permit removal of a circular primary package held within the secondary package. The score ring (1421) of the openings (1423) is sufficiently large to allow a primary package held within the secondary package to pass through the opening (1423) when a user removes a primary package from the secondary package.

The side panels (1406) that make up the rectangular secondary package blank (1400) are connected by fold lines (1408). The side panels (1406) include flaps (1410, 1411, 1412, 1414, 1416, 1417, 1418) connected by fold lines (1409). Flaps (1414) contain die-cuts (1428) to form punch-in openings that may be used as handles to lift and carry the secondary package when the secondary package has been fully assembled from the secondary package blank (1400). The die cuts (1428) are configured with a score line (1430) for forming punch-in openings. Die cut (1428) and score line (1430) are located on flap (1414) attached to lid (1402) and allow a person carrying the rectangular secondary package assembled from the secondary package blank (1400) to punch in the die cut (1428) with several fingers and lift or hold the assembled rectangular secondary package.

Another die cut (1424) and score line (1426) combination is located on a flap (1412) of at least one side panel (1406). This die cut (1424) and score line (1426) combination is located and configured to overlap die cut (1428) and score line (1430), located on flap (1414) attached to lid (1402), when the secondary package has been fully assembled from the secondary package blank (1400). This allows a person carrying the secondary package assembled from the secondary package blank (1400) to punch in the overlapping die cuts (1424 and 1428) with several fingers and lift the assembled rectangular secondary package.

An optional window may be located in a side panel of the secondary packages of the present invention. When present, this window allows a user to view some or all of the contents of the secondary package. When present in a rectangular embodiment of the secondary packaging of the present invention, this window may be located on a flap connected to a side panel. Such window is depicted in FIG. 14A as die cut (1432) is located on flap (1416) of at least one side panel (1406). This die cut (1432) is located and configured to overlap die cut (1433) on flap (1417) attached to base (1404) when the secondary package has been fully assembled from the secondary package blank (1400).

The base (1404) is provided with twelve stabilizing posts (1434) configured to align with and interlock with the base of one or more primary packages intended to be carried in the rectangular secondary package formed from the secondary package blank (1400).

Flaps (1410, 1411, 1412, 1414, 1416, 1417, 1418) form a connection point between side panels (1406), top (1402) and base (1404) of the rectangular secondary package allowing for easy and efficient assembly of a rectangular secondary package from the secondary package blank (1400). These tabs may be connected to form the rectangular secondary package by any standard means including gluing, stapling, sewing, or the like.

FIG. 14B shows a side elevation view of the rectangular secondary package (1440) assembled from a secondary package blank (1400) depicted in FIG. 14A. The assembled package (1440) includes five primary packages (1442) of materials, particularly liquids. The assembled secondary package (1440) is formed in a rectangular shape composed of two side panels (1444), a base (1404) and a lid (1402), which closes the top of the rectangular secondary package (1440). The assembled secondary package is shown loaded with five primary packages (1442) projecting through openings in lid (1402). Stabilizing posts (1434) align with and interlock with the base of one or more primary packages (1442) intended to be carried in the rectangular secondary package formed from the secondary package blank (1400). An opening in the lid (1402) will align with the top of a primary package (1442). An optional bottleneck stabilizing ring may be included in the primary packaging to align below the lid of a secondary package of the invention. In the configuration depicted in FIG. 14B including primary packages (1442) having a bottleneck stabilizing ring (1436), the stabilizing post (1434) located on the inside of the base (1404) of the rectangular secondary package (1442) will interlock with the bottom of the primary package (1442). The primary package (1442) is thereby biaxially supported, and held in a stable position between the bottleneck stabilizing ring (1436) (or within a close-fitting opening in the lid (1402)) and the stabilizing post (1434) within the secondary packaging of the present invention.

FIG. 14C shows a top plan view of a rectangular secondary package (1450) of the present invention including twenty primary packages (1452) of materials, particularly liquids. The assembled secondary package (1450) is formed in a rectangular shape composed of two side panels (1454), a base and a lid (1456), which closes the top of the rectangular secondary package (1452). The twenty primary packages (1452) project through openings (1458) in lid (1456). Die-cut opening (1460) may be punched in under score line (1462) to form a handle that may be used to hold and carry the secondary package (1450). The handle that is formed from die cut (1460) under score line (1462) is preferably of sufficient size to accommodate at least three fingers of a person carrying the secondary package (1450).

Figure 15:
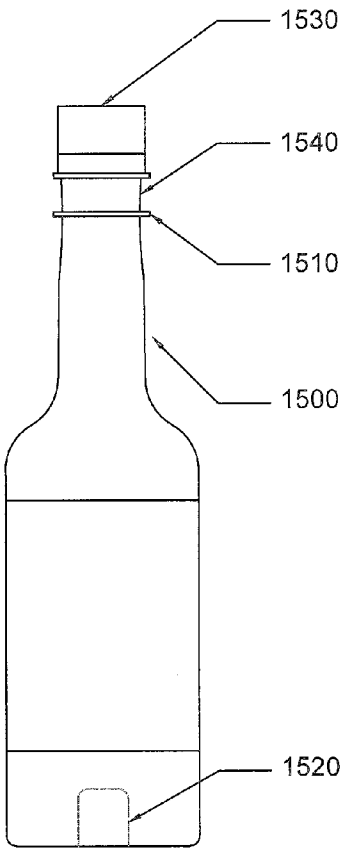
FIG. 15 is a side view of a primary package that may be used in the secondary package forming a dispensing system of the invention.

FIG. 15 depicts a primary package (1500) particularly well-suited for use in the hexagonal secondary package of the present invention. As with all of the primary packaging referenced herein, the primary package (1500) may be, for example, molded aluminum, glass, plastic, or the like. The primary package (1500) includes a stabilizing depression (1520). Designed to receive and interlock with a stabilizing post on the basis of the hexagonal secondary package of the invention, as depicted in FIG. 12, reference number (1242). The primary package (1500) may also include a bottleneck stabilizing ring (1510). When the bottle (1500) is located in a secondary package of the present invention, bottle top (1530) can be positioned to project through an opening in the lid of the secondary package (for example, FIG. 12, opening (1239); also depicted in FIG. 1). Apertures cut into the lid around the opening will align with the narrow neck (1540) between the bottle top (1530) and optional bottleneck stabilizing ring (1510). In this configuration, a stabilizing post located on the inside of the base of the secondary package will match and interlock with the stabilizing depression (1520) on the bottom of the bottle. The primary package (1500) is thereby biaxially supported, and held in a stable position between the bottleneck stabilizing ring (1510) (or within a close-fitting opening in a lid) and the stabilizing depression (1520) within the secondary packaging of the present invention.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A dispensing system comprising:

side panels formed into a tubular form, connected by fold lines and comprising openings configured to allow lifting and carrying the assembled dispensing system;

a lid mating with and enclosing a first end of the tubular form;

a bottom panel mating with and enclosing a second end opposing the first end of the tubular form;

at least one aperture formed in the lid comprising a plurality of cuts in a hexagonal pattern that radiate outwardly towards a circular score ring;

at least one stabilizing post formed on the bottom panel in a position opposite the at least one aperture;

at least one primary package comprising a body, a neck extending upwardly from the body, a mouth at a top of said neck, a closure closing said mouth, a flange adjacent said mouth, a stabilizing ring positioned around said neck between said body and said flange, and a depression in the bottom of the primary package for reversibly interlocking with the at least one stabilizing post, disposed within the secondary package, wherein said at least one primary package is supported at one end about said neck by the at least one aperture enclosed by the flange adjacent said mouth and the stabilizing ring positioned around said neck on opposite sides of the aperture;

wherein said at least one primary package is further supported at the opposing end by the depression in the bottom of the primary package reversibly interlocking with the at least one stabilizing post formed on the bottom panel of the dispensing system.

2. The dispensing system of claim 1, wherein the tubular form of the dispensing system comprises a hexagonal shape.

3. The dispensing system of claim 2, further comprising an internal stabilizing member disposed within the hexagonal dispensing system and comprising a central hub with at least three arms connected to the central hub and radiating from the central hub to the side panels of the hexagonal dispensing system.

4. The dispensing system of claim 1, wherein the tubular form of the dispensing system comprises a rectangular shape.

5. The dispensing system of claim 1, further comprising an internal stabilizing member for stabilizing and strengthening the dispensing system comprising:

a central hub; and, at least three arms connected to the central hub and extending laterally from the central hub.

6. The dispensing system of claim 1, wherein said openings comprise three openings in a side panel, and one opening in an adjacent side panel configured to allow insertion of three fingers into the three openings, and a thumb into the opening in an adjacent side panel, such that a user can clasp the assembled secondary package in one hand.

7. The dispensing system of claim 1, wherein said openings comprise an elongated opening in a side panel, and one opening in an adjacent side panel configured to allow insertion of three fingers into the elongated opening, and a thumb into the opening in an adjacent side panel, configured so that a user can clasp the assembled secondary package in one hand.

8. The dispensing system of claim 7, wherein said openings are located in the side panels between parallel fold lines.

9. The dispensing system of claim 7, wherein said openings form a hand grip permitting the assembled secondary package to be carried in suitcase fashion.

* * * * *